US010551772B2

(12) United States Patent
Kyotani

(10) Patent No.: US 10,551,772 B2
(45) Date of Patent: Feb. 4, 2020

(54) IMAGE FORMING APPARATUS AND SHEET CONVEYING METHOD

(71) Applicant: Brother Kogyo Kabushiki Kaisha, Nagoya-shi, Aichi-ken (JP)

(72) Inventor: Tadao Kyotani, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 94 days.

(21) Appl. No.: 15/933,453

(22) Filed: Mar. 23, 2018

(65) Prior Publication Data

US 2019/0004457 A1 Jan. 3, 2019

(30) Foreign Application Priority Data

Jun. 29, 2017 (JP) ..... 2017-127230

(51) Int. Cl.

| | |
|---|---|
| ***G03G 15/00*** | (2006.01) |
| ***G03G 21/00*** | (2006.01) |
| ***G03G 15/20*** | (2006.01) |
| ***G03G 15/08*** | (2006.01) |

(52) U.S. Cl.

CPC ..... *G03G 15/2014* (2013.01); *G03G 15/0849* (2013.01); *G03G 15/6511* (2013.01); *G03G 15/6555* (2013.01)

(58) Field of Classification Search

CPC ..... G03G 15/2014; G03G 15/0849; G03G 15/6511; G03G 15/6555

See application file for complete search history.

(56) References Cited

U.S. PATENT DOCUMENTS

| | | | | |
|---|---|---|---|---|
| 2009/0028587 | A1 | 1/2009 | Hanashi et al. | |
| 2010/0276870 | A1 | 11/2010 | Yamada | |
| 2015/0003883 | A1* | 1/2015 | Honda | G03G 15/6529 399/406 |

FOREIGN PATENT DOCUMENTS

| | | | |
|---|---|---|---|
| JP | H06-127055 | A | 5/1994 |
| JP | 2006-243498 | A | 9/2006 |
| JP | 2009-031581 | A | 2/2009 |
| JP | 2010-262085 | A | 11/2010 |

* cited by examiner

*Primary Examiner* — David M. Gray
*Assistant Examiner* — Michael A Harrison
(74) *Attorney, Agent, or Firm* — Banner & Witcoff, Ltd.

(57) ABSTRACT

An image forming apparatus has a feed tray, a transferring unit, a fixing unit, a output tray, a conveying unit for conveying a sheet along a sheet conveyance path including a first sheet conveyance path and a second sheet conveyance path which branches from the first sheet conveyance path on a downstream side and joins to the first sheet conveyance path on a upstream side, and a controller. The controller causes the conveying unit to convey sheets, calculates a specific amount related to the amount of toner per unit area of a page in image data, performs double-sided printing with the large number of sheets conveyed in a case where the specific amount is smaller than a predetermined amount, and performs double-sided printing with the small number of sheets conveyed in a case where the specific amount is equal to or larger than the predetermined amount.

14 Claims, 12 Drawing Sheets

FIG. 8

AREA-SPECIFIC COEFFICIENTS FOR SYSTEM OF CONVEYING THREE SHEETS AT ONCE

SHEET CONVEYANCE DIRECTION

| | | | | | | |
|---|---|---|---|---|---|---|
| 0.3 | 0.2 | 0.2 | 0.2 | 0.2 | 0.2 | 0.3 |
| 0.3 | 0.2 | 0.2 | 0.2 | 0.2 | 0.2 | 0.3 |
| 0.5 | 0.4 | 0.4 | 0.4 | 0.4 | 0.4 | 0.5 |
| 0.7 | 0.6 | 0.6 | 0.6 | 0.6 | 0.6 | 0.7 |
| 0.8 | 0.7 | 0.7 | 0.7 | 0.7 | 0.7 | 0.8 |
| 0.9 | 0.8 | 0.8 | 0.8 | 0.8 | 0.8 | 0.9 |
| 1 | 0.9 | 0.9 | 0.9 | 0.9 | 0.9 | 1 |
| 1 | 1 | 1 | 1 | 1 | 1 | 1 |

FIG. 9

COEFFICIENTS FOR PRINT PAGES FOR SYSTEM OF CONVEYING THREE SHEETS AT ONCE

| PRINT PAGE | |
|---|---|
| 1 | 0.8 |
| 2 | 1 |
| 3 | 0.7 |
| 4 | 0.5 |
| 5 | 0.3 |
| 6 AND MORE | 0 |

FIG. 10

AREA-SPECIFIC COEFFICIENTS FOR SYSTEM OF CONVEYING TWO SHEETS AT ONCE

SHEET CONVEYANCE DIRECTION

| | | | | | | |
|---|---|---|---|---|---|---|
| 0.3 | 0.2 | 0.2 | 0.2 | 0.2 | 0.2 | 0.3 |
| 0.3 | 0.2 | 0.2 | 0.2 | 0.2 | 0.2 | 0.3 |
| 0.5 | 0.4 | 0.4 | 0.4 | 0.4 | 0.4 | 0.5 |
| 0.6 | 0.5 | 0.5 | 0.5 | 0.5 | 0.5 | 0.6 |
| 0.7 | 0.6 | 0.6 | 0.6 | 0.6 | 0.6 | 0.7 |
| 0.9 | 0.8 | 0.8 | 0.8 | 0.8 | 0.8 | 0.9 |
| 0.9 | 0.8 | 0.8 | 0.8 | 0.8 | 0.8 | 0.9 |
| 1 | 0.9 | 0.9 | 0.9 | 0.9 | 0.9 | 1 |

FIG. 11

COEFFICIENTS FOR PRINT PAGES FOR SYSTEM OF CONVEYING TWO SHEETS AT ONCE

| PRINT PAGE | |
|---|---|
| 1 | 0.8 |
| 2 | 0.9 |
| 3 | 0.7 |
| 4 | 0.4 |
| 5 | 0.2 |
| 6 AND MORE | 0 |

IMAGE FORMING APPARATUS AND SHEET CONVEYING METHOD

CROSS-REFERENCE TO RELATED APPLICATION

This application claims priority from Japanese Patent Application No. 2017-127230 filed on Jun. 29, 2017, the entire subject-matter of which is incorporated herein by reference.

TECHNICAL FIELD

The present disclosure relates to an electrophotographic image forming apparatus capable of double-sided printing, and a sheet conveying method of the image forming apparatus.

BACKGROUND

In the related art, image forming apparatuses using a system for performing printing on one side of a sheet and then performing printing on the other side while printing on one side of another sheet, i.e. a system for consecutively performing single-sided printing on a plurality of sheets (hereinafter, referred to as a system of conveying a plurality of sheets at once), as a sheet conveying system for performing double-sided printing, are known.

Image forming apparatuses each of which supports a plurality of conveying systems are known. For example, there has been disclosed a technology for performing switching between conveying systems on the basis of sheet jam occurrence probabilities in an image forming apparatus supporting a plurality of conveying systems different in the maximum number of sheets which can exist in a conveying mechanism at the same time.

It is susceptible for an electrophotographic image forming apparatuses to be improved in control on sheet conveyance for the double-sided printing. The difference between the current temperature of a rotator of a fixing unit and a fixing temperature is small just after the temperature of the rotator reaches the fixing temperature. A temperature at which it is possible to adequately fix a toner image on one sheet is set as the fixing temperature. Therefore, in a system of conveying a large number of sheets per unit time like the above-mentioned system of conveying a plurality of sheets at once, when the rotator loses heat due to passage of a sheet, whereby the temperature of the rotator becomes lower than the fixing temperature, the rotator may not adequately recover the temperature required to secure fixing strength until the next sheet arrives. On the other, although it is easy for a system conveying a small number of sheets per unit time to secure a time required to recover the temperature of a rotator, productivity is low.

SUMMARY

The specification discloses a sheet conveying technology suitable to perform double-sided printing in an electrophotographic image forming apparatus.

One illustrative aspect provides an image forming apparatus having:

a feed tray;

a transferring unit configured to transfer toner onto a sheet;

a fixing unit including a heater and a rotator configured to be heated by the heater;

a output tray;

a conveying unit configured to convey a sheet along a sheet conveyance path including a first sheet conveyance path for conveying a sheet fed from the feed tray to the output tray through the transferring unit and the fixing unit, and a second sheet conveyance path branching from the first sheet conveyance path on a downstream side of a sheet conveyance direction from the fixing unit and joining to the first sheet conveyance path on a upstream side of the sheet conveyance direction from the transferring unit, wherein the sheet conveyance direction is a direction in that a sheet is conveyed along the first sheet conveyance path; and a controller configured to:

receive image data of a plurality of pages;

calculate a specific amount related to the amount of toner per unit area of a page, where an N-th object of image formation is formed in a case of conveying sheets by conveying a first number of sheets along the sheet conveyance path by the conveying unit, in the image data, wherein the parameter "N" is equal to or larger than 2;

in a case where the specific amount is smaller than a predetermined amount, perform double-sided printing by causing the conveying unit to simultaneously convey the first number of sheets along the sheet conveyance path; and in a case where the specific amount is equal to or larger than the predetermined amount, perform double-sided printing by causing the conveying unit to simultaneously convey a second number of sheets along the sheet conveyance path, wherein the second number is smaller than the first number.

The aspect provides an image forming apparatus having:

a feed tray;

a transferring unit configured to transfer toner onto a sheet;

a fixing unit including a heater and a rotator configured to be heated by the heater;

a output tray;

a conveying unit configured to convey a sheet along a sheet conveyance path including a first sheet conveyance path for conveying a sheet fed from the feed tray to the output tray through the transferring unit and the fixing unit, and a second sheet conveyance path branching from the first sheet conveyance path on a downstream side of a sheet conveyance direction from the fixing unit and joining to the first sheet conveyance path on a upstream side of the sheet conveyance direction from the transferring unit, wherein the sheet conveyance direction is a direction in that a sheet is conveyed along the first sheet conveyance path; and a controller configured to:

receive image data of a plurality of pages;

calculate a specific amount related to the amount of toner per unit area of a page, where an N-th object of image formation is formed in a case of performing double-sided printing, wherein while conveying one sheet along the second sheet conveyance path from a branch point of the first sheet conveyance path and the second sheet conveyance path to a joint point of the first sheet conveyance path and the second sheet conveyance path, the controller causes the conveying unit to convey a sheet other than the one sheet along the first sheet conveyance path, in the image data, wherein the parameter "N" is equal to or larger than 2;

in a case where the specific amount is smaller than a predetermined amount, perform the double-sided printing, wherein while conveying one sheet along the second sheet conveyance path from a branch point of the first sheet conveyance path and the second sheet conveyance path to a joint point of the first sheet conveyance path and the second sheet conveyance path, the controller causes the conveying unit to convey a sheet other than the one sheet along the first sheet conveyance path; and in a case where the specific amount is equal to or larger than the predetermined amount, perform double-sided printing, wherein while conveying one sheet along the second sheet conveyance path from the branch point of the first sheet conveyance path and the second sheet conveyance path to the joint point of the first sheet conveyance path and the second sheet conveyance path, the controller causes the conveying unit not to convey a sheet other than the one sheet along the first sheet conveyance path.

The aspect provides a sheet conveying method of an image forming apparatus that includes:

a feed tray;

a transferring unit configured to transfer toner onto a sheet;

a fixing unit including a heater and a rotator configured to be heated by the heater;

a output tray;

a conveying unit configured to convey a sheet along a sheet conveyance path including a first sheet conveyance path for conveying a sheet fed from the feed tray to the output tray through the transferring unit and the fixing unit, and a second sheet conveyance path branching from the first sheet conveyance path on a downstream side of a sheet conveyance direction from the fixing unit and joining to the first sheet conveyance path on a upstream side of the sheet conveyance direction from the transferring unit, wherein the sheet conveyance direction is a direction in that a sheet is conveyed along the first sheet conveyance path; and a controller, the method, executed by the controller, includes the steps of:

receiving image data of a plurality of pages;

calculating a specific amount related to the amount of toner per unit area of a page, where an N-th object of image formation is formed in a case of conveying sheets by conveying a first number of sheets along the sheet conveyance path by the conveying unit, in the image data, wherein the parameter "N" is equal to or larger than 2;

in a case where the specific amount is smaller than a predetermined amount, performing double-sided printing by causing the conveying unit to simultaneously convey the first number of sheets along the sheet conveyance path; and in a case where the specific amount is equal to or larger than the predetermined amount, performing double-sided printing by causing the conveying unit to simultaneously convey a second number of sheets along the sheet conveyance path, wherein the second number is smaller than the first number.

The aspect provides an image forming apparatus having:

a feed tray configured to stock sheets;

an image forming unit configured to provide toner on a sheet conveyed from the feed tray to form an image based on image data on the sheet;

a re-conveying unit configured to convey the sheet that the image is formed by the image forming unit along a circulation path to feed the sheet back to the image forming unit; and a controller configured to:

calculate, according to the image data, a specific value related to an amount of toner provided on the sheet to form the image;

determine whether or not the calculated specific value is larger than a predetermined threshold;

in a case where the controller determines that the specific value does not exceed the predetermined threshold, control the re-conveying unit to convey a first number of sheets held along the circulation path; and in a case where the controller determines that the specific value exceeds the predetermined threshold, control the re-conveying unit to convey a second number of sheets held along the circulation path, wherein the second number is smaller than the first number.

The image forming apparatus and the sheet conveying method disclosed in this specification can perform a plurality of conveying processes different in the numbers of sheets they simultaneously convey, as conveying processes in the case of performing double-sided printing on a plurality of sheets, and determines a conveying process according to an amount calculated with respect to each of pages to be the second object and the subsequent objects of image formation and related to the amount of toner per unit area. Specifically, in the case where an amount related to the amount of toner per unit area is smaller than the predetermined amount, the image forming apparatus performs the conveying process of processing a large number of sheets per unit time; whereas in the case where an amount related to the amount of toner per unit area is equal to or larger than the predetermined amount, the image forming apparatus performs the conveying process of processing a small number of sheets per unit time.

As the number of sheets which are simultaneously conveyed along the sheet conveyance path increases, the interval between sheets tends to decrease. Further, as the interval between sheets decreases, the time available to recover the temperature of the rotator after passage of a preceding sheet decreases. In the case where the amounts of toner per unit area are small, even though the recovery time is short, appropriate fixing strength is likely to be achieved. Therefore, the image forming apparatus and the sheet conveying method disclosed in this specification performs a conveying process capable of simultaneously conveying a large number of sheets along the sheet conveyance path, thereby improving the productivity. Meanwhile, in the case where the amount of toner per unit area is large, the image forming apparatus disclosed in this specification performs a conveying process of simultaneously conveying a small number of sheets along the sheet conveyance path, thereby lengthening the recovery time and securing fixing quality. In other words, according to the image forming apparatus and the sheet conveying method disclosed in this specification, since a conveying process is determined according to an amount calculated with respect to each of pages to be the second object and the subsequent objects of image formation and related to the amount of toner per unit area, while securing fixing quality, it is possible to suppress a decrease in the productivity. Therefore, with respect to electrophotographic image forming apparatuses, it is possible to expect sheet conveyance technologies suitable to perform double-sided printing.

Control methods and computer programs for implementing the functions of the above-described image forming apparatus, and a computer-readable storage device retaining the corresponding computer programs also are new and useful.

According to the above configuration of the image forming apparatus and the sheet conveying method, a sheet conveying technology suitable to perform double-sided printing is implemented in an electrophotographic image forming apparatus.

BRIEF DESCRIPTION OF DRAWINGS

Illustrative aspects will be described in detail with reference to the following figures.

FIG. 8 is a table representing examples of area-specific coefficients which are usable in the system of conveying three sheets at once.

FIG. 9 is a table representing examples of page-specific coefficients which are usable in the system of conveying three sheets at once.

FIG. 10 is a table representing examples of area-specific coefficients which are usable in the system of conveying two sheets at once.

FIG. 11 is a table representing examples of page-specific coefficients which are usable in the system of conveying two sheets at once.

DETAILED DESCRIPTION

Hereinafter, a first aspect of an image forming apparatus according to the present disclosure will be described in detail with reference to the accompanying drawings. The present aspect is an aspect in which the present disclosure is applied to a printer having an image forming function using an electrophotographic system.

Figure 1:
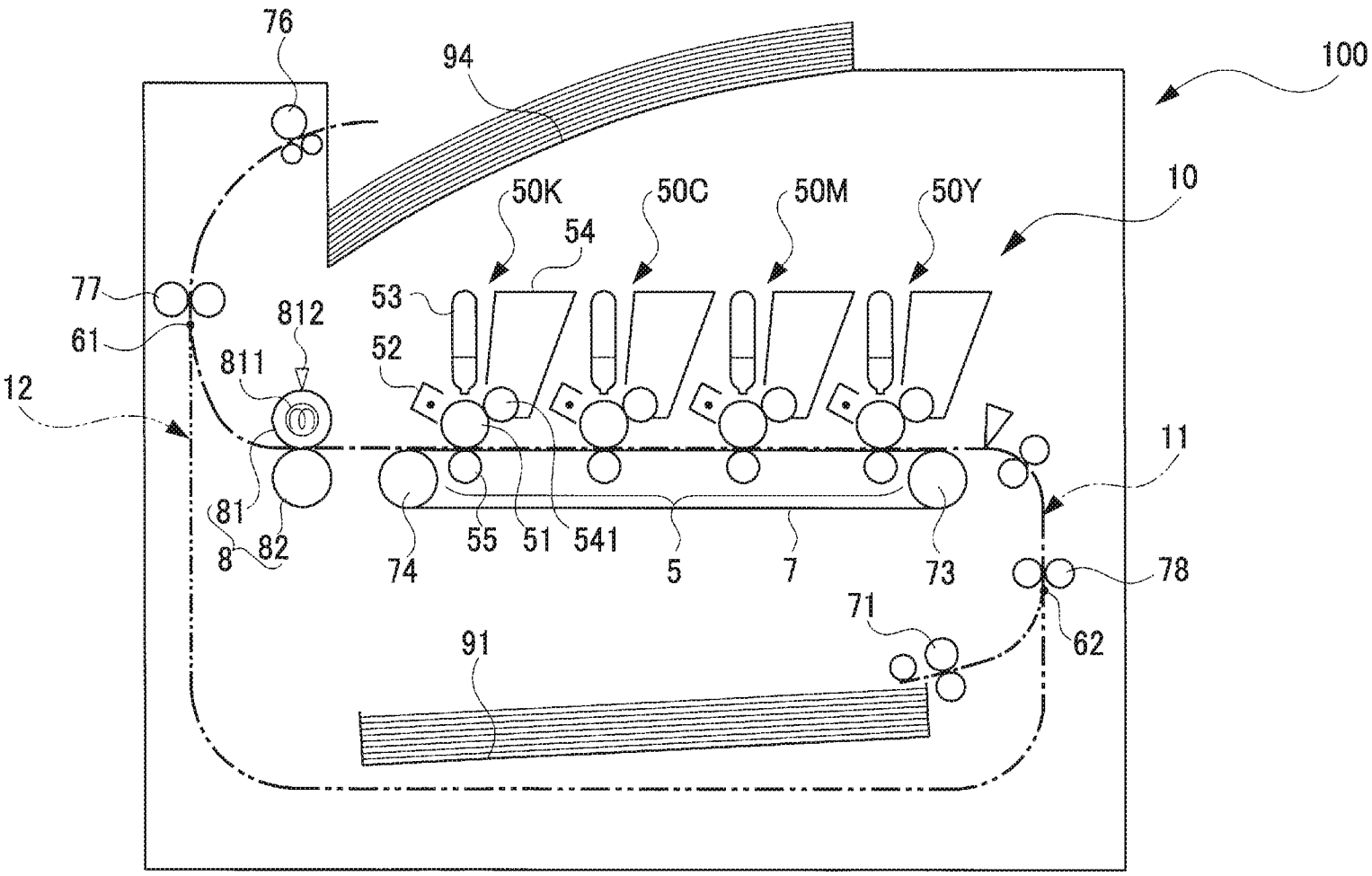
FIG. 1 is a cross-sectional view illustrating a rough configuration of a printer according to the aspects.

As shown in FIG. 1, a printer 100 of the present aspect includes an image forming unit 10 configured to print images on sheets, a feed tray 91 for setting sheets to be used in printing, and a output tray 94 on which printed sheets are placed. As shown in FIG. 1, the image forming unit 10 of the printer 100 includes a processing unit 5 configured to form toner images on sheets by the electrophotographic system, a conveying belt 7 configured to convey sheets to the processing unit 5, and a fixing unit 8 configured to fix unfixed toner images formed on sheets to the sheets. The conveying belt 7 conveys sheets along the processing unit 5 from the right of FIG. 1 to the left, i.e. from the processing unit 5 toward the fixing unit 8. The conveying belt 7 is an example of a conveying unit.

The printer 100 of the present aspect is an apparatus forming color images. As shown in FIG. 1, the processing unit 5 of the printer 100 has a processing unit 50Y for yellow (Y), a processing unit 50M for magenta (M), a processing unit 50C for cyan (C), and a processing unit 50K for black (K) arranged sequentially from the side far from the fixing unit 8. Each sheet which is conveyed by the conveying belt 7 passes through the processing units 50 for the individual colors in the order of 50Y, 50M, 50C, and 50K. The processing units 50Y, 50M, 50C, and 50K for the individual colors all have the same configuration except for toner colors, and are disposed along the conveying belt 7 in parallel. Hereinafter, in the case where it is not required to distinguish the colors, they will be referred to simply as the processing units 50. The arrangement order of the processing units 50 for the individual colors is not limited to the configuration of FIG. 1, and may be changed.

As shown in the processing unit 50K of FIG. 1, each of the processing units 50 for the individual colors has a photosensitive drum 51 which is a drum-shaped photosensitive element, and has a charging unit 52, an exposing unit 53, a developing unit 54, and a transferring unit 55 sequentially arranged in the rotation direction of the photosensitive drum 51 around the photosensitive drum 51. The photosensitive drum 51 rotates in such a direction that the progress direction of the surface corresponds to the progress direction of sheets, i.e. clockwise as seen in FIG. 1.

The charging unit 52 is, for example, a scorotron charger, and charges the surface of the photosensitive drum 51 almost uniformly. The exposing unit 53 is, for example, an LED type exposing device, and radiates light onto the photosensitive drum 51, thereby forming electrostatic latent images based on image data on the photosensitive drum 51. The developing units 54 has a developing roller 541, and develops electrostatic latent images formed on the photosensitive drum 51 by feeding toner by the developing roller 541, thereby forming toner images on the photosensitive drum 51. The transferring unit 55 electrically attracts toner images formed on the photosensitive drum 51, thereby transferring the toner images onto sheets conveyed by the conveying belt 7.

The fixing unit 8 has a heating roller 81 and a pressing roller 82, and fixes toner images to sheets. The heating roller 81 has a heater 811 inside, and is a rotator whose outer periphery is heated by the heater 811. The heating roller 81 is an example of a rotator. However, the heating roller 81 is not limited to a roller, and may be configured with a rotary belt. Examples of the heater 811 include halogen heaters, ceramic heaters, and IH heaters. The pressing roller 82 is, for example, a rubber roller, and is pressed against the heating roller 81. The fixing unit 8 fixes toner images transferred on sheets by the transferring unit 55 to the sheets by heating the toner images while pressing them.

Further, the printer 100 includes a temperature sensor 812 for detecting the temperature of the surface of the heating roller 81 of the fixing unit 8. The temperature sensor 812 detects the temperature of the surface of the heating roller 81, for example, at the center position of the heating roller 81 in the roller axis direction, and outputs a signal corresponding to the detected temperature. The printer 100 controls supply of power to the heating roller 81 on the basis of the output signal of the heating roller 81 such that the temperature of the surface of the heating roller 81 falls within an appropriate temperature range. For example, in the case where it is determined that the temperature of the surface of the heating roller 81 is lower than the appropriate temperature range, the printer 100 performs control such that power is supplied to the heating roller 81, thereby heating the heating roller 81. However, the printer 100 may have a plurality of temperature sensors 812. For example, the printer may have temperature sensors on the center part and the end parts of the heating roller 81 in the roller axis direction, respectively.

The printer 100 has a print path 11 shown by an alternate long and short dash line in FIG. 1, and an reverse path 12 shown by an alternate long and two short dashes line in FIG. 1, as paths for converting sheets. The print path 11 is an example of a first sheet conveyance path, and the reverse path 12 is an example of a second sheet conveyance path. Further, the whole of the print path 11 and the reverse path 12 is an example of a sheet conveyance path. The print path 11 is a path starting from the feed tray 91 and sequentially passing through the processing unit 5 and the fixing unit 8 and reaching the output tray 94. The printer 100 forms images on sheets for printing by the processing unit 5 and the fixing unit 8 while conveying the sheets along the print path 11, and discharges the printed sheets onto the output tray 94.

The reverse path 12 is a path which branches from the print path 11 at a branch point 61 positioned on the downstream side from the fixing unit 8 and on the upstream side from the output tray 94 in the sheet conveyance direction of the print path 11, as shown in FIG. 1. Further, the reverse path 12 is a path which joins the print path 11 at a joint point 62 positioned on the downstream side from the feed tray 91 and on the upstream side from the processing unit 5 in the sheet conveyance direction of the print path 11. The reverse path 12 is a path for conveying sheets while bypassing the processing unit 5 and the fixing unit 8.

Furthermore, the printer 100 has a plurality of rollers for conveying sheets along the print path 11 and the reverse path 12 as shown in FIG. 1. The printer 100 has, for example, a feeding roller 71 for drawing out sheets from the feed tray 91, two belt rollers 73 and 74 for rotating the conveying belt 7, a discharging roller 76 for discharging sheets onto the output tray 94, an reversing roller 77, and a joint roller 78.

The reversing roller 77 is disposed on the print path 11 between the branch point 61 and the discharging roller 76. The printer 100 can rotate a motor 65 (See FIG. 2.) configured to rotate the reversing rollers 77 in both of a normal rotation direction and a reverse rotation direction. Further, the printer 100 controls the rotation direction of the motor 65 such that the sheet conveyance direction is reversed by the reversing roller 77.

The joint roller 78 is disposed on the print path 11 between the joint point 62 and the processing unit 5. Sheets having passed through the joint point 62 along the print path 11 or the reverse path 12 are conveyed toward the processing unit 5 by the joint roller 78. The printer 100 may include various members for conveyance besides the members shown in the drawings.

In the printer 100 of the present aspect, various roller members for conveyance provided on the sheet conveyance paths except the feeding roller 71 and the reversing roller 77 perform a conveying operation together. Therefore, for example, the speed at which a sheet fed from the feed tray 91 is conveyed along the print path 11 is the same as the speed at which a sheet reversed by the reversing roller 77 is conveyed along the reverse path 12.

During printing, the printer 100 draws out sheets from the feed tray 91 by the feeding roller 71 and conveys them toward the processing unit 5 along the print path 11. The processing unit 5 forms toner images on the photosensitive drums 51, and transfers the formed toner images onto the sides of sheets facing the photosensitive drums 51 by the transferring unit 55 while the sheets are conveyed along the print path 11. Then, the printer 100 fixes the toner images transferred on the sheets to the sheets by the fixing unit 8. In the case of single-sided printing, the printer 100 discharges sheets with their printed sides down onto the output tray 94.

In the case of double-sided printing, after the rear end of each sheet subjected to single-sided printing passes through the branch point 61 and before the rear end passes the reversing roller 77, the printer 100 stops rotation of the reversing roller 77, and reverses the rotation direction of the reversing roller 77, and rotates the reversing roller, thereby reversing the conveyance direction of the corresponding sheet. Further, the printer 100 conveys the corresponding sheet whose conveyance direction has been reversed to the joint point 62 along the reverse path 12 bypassing the processing unit 5, and guides the corresponding sheet to the print path 11. As a result, the corresponding sheet is inverted such that the opposite side to the printed side faces the photosensitive drums 51, and then is re-conveyed to the processing unit 5. Then, the printer 100 transfers toner images newly formed by the processing unit 5 onto the unprinted side of the corresponding sheet. In this way, the printer makes each sheet having images on both sides.

Figure 2:
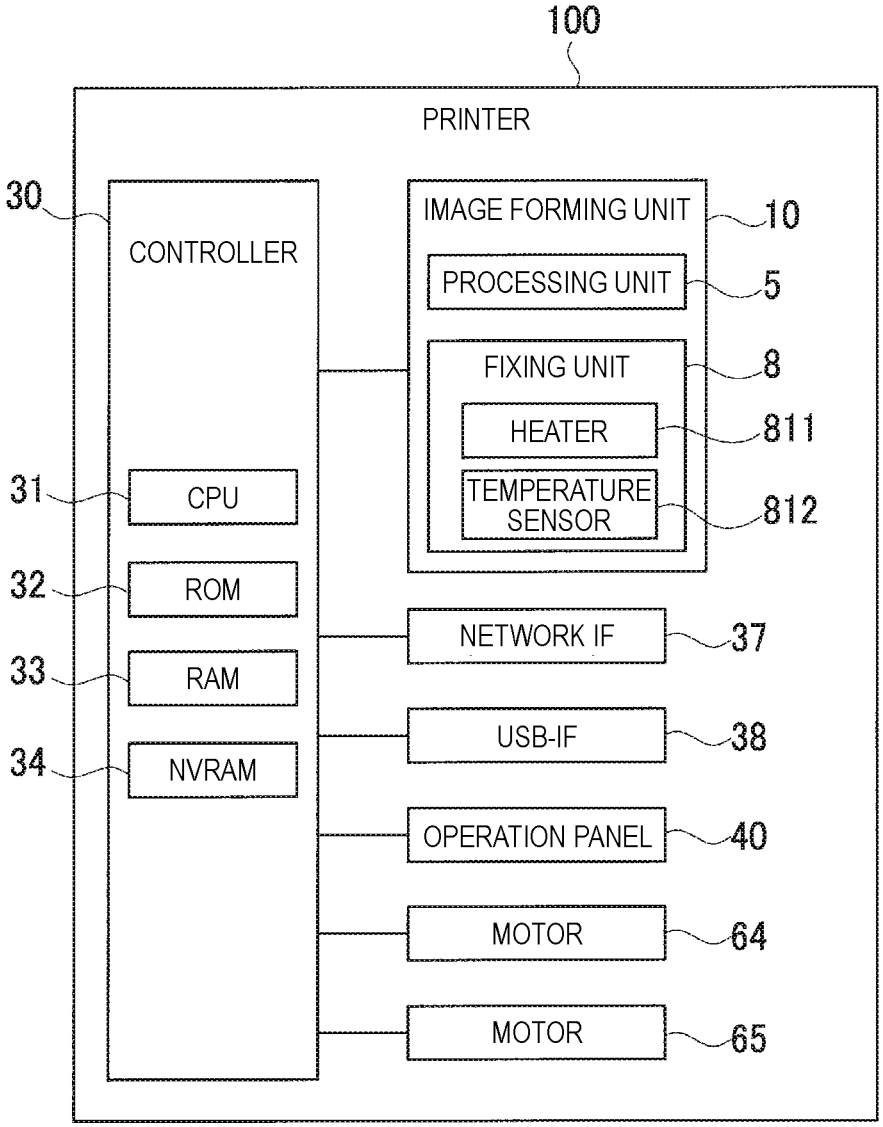
FIG. 2 is a block diagram illustrating the electrical configuration of the printer.

Now, the electrical configuration of the printer 100 will be described. As shown in FIG. 2, the printer 100 includes a controller 30 including a CPU 31, a ROM 32, a RAM 33, and a NVRAM (non-volatile RAM) 34. The printer 100 includes the image forming unit 10, a network interface (network IF) 37, a USB interface (USB-IF) 38, an operation panel 40, a motor 64, and the motor 65, which are electrically connected to the controller 30.

In the ROM 32, a variety of information such as various control programs for controlling the printer 100, various settings, and initial values are stored. The RAM 33 is used as a work area to which various control programs can be loaded and as a storage area for temporarily storing data. According to control programs read from the ROM 32, the CPU 31 controls each component of the printer 100 while storing processing results of the control programs in the RAM 33 or the NVRAM 34.

The CPU 31 is an example of a controller. However, the controller 30 may be an example of the controller. The controller 30 of FIG. 2 is a generic term for hardware usable for control of the printer 100, such as the CPU 31, and is not limited to a term for a piece of hardware actually existing in the printer 100.

The network IF 37 is hardware for performing communication with external devices connected via a network. The USB-IF 38 is hardware for performing communication with external devices connected on the basis of USB. The operation panel 40 includes a display, a button group composed of various keys such as a start key, a stop key, and numeric keys, and performs display of various messages, and receives user's instruction inputs.

The motor 64 is a rotary drive member which can rotate only in one direction. The motor 64 rotates the heating roller 81 of the fixing unit 8 and various rollers for conveyance other than the reversing roller 77. The motor 64 may also rotate various rotary members included in the processing unit 5, such as the photosensitive drums 51. The motor 65 is a rotary drive member for rotating the reversing roller 77, and is a motor capable of reverse rotation. The motor 64 and the motor 65 are examples of a conveying unit.

Now, sheet conveying systems which the printer 100 of the present aspect can use to perform double-sided printing will be described. The printer 100 has three conveying systems, i.e. (1) a system of conveying one sheet at once, (2) a system of conveying two sheets at once, and (3) a system of conveying three sheets at once, as sheet conveying systems which can be used to consecutively perform double-sided printing on a plurality of sheets. When the printer 100 receives a print job of double-sided printing on a plurality of sheets, the printer 100 selects one from the three conveying systems and uses the selected one. The printer 100 can also switch to a different conveying system in the course of performance of a print job.

(1) System of Conveying One Sheet at Once

The system of conveying one sheet at once is a conveying system usable in a printing procedure in which after printing on both sides of one sheet is performed, printing on the next sheet is started. By the system of conveying one sheet at once, after conveying one sheet along the print path 11, and reverses the conveyance direction, and conveys the sheet along the reverse path 12, and re-conveys the sheet from the joint point 62 to the print path 11, the printer 100 feeds the next sheet. In short, in the system of conveying one sheet at once, while conveying one sheet along the reverse path 12, the printer 100 does not convey any other sheet along the print path 11.

As described above, the printer 100 discharges sheets with their printed sides down onto the output tray 94. To this end, the printer first prints a second page of a print job on one side of a sheet, and then prints a first page of the print job on the other side. As a result, the printed sheet is discharged with the first page down. In other words, in the case of performing double-sided printing by conveyance of the system of conveying one sheet at once, the printer 100 performs printing in the order of one side of a first sheet (a second page), the other side of the first sheet (a first page), one side of a second sheet (a fourth page), and the other side of the second sheet (a third page).

(2) System of Conveying Two Sheets at Once

Figure 3A:
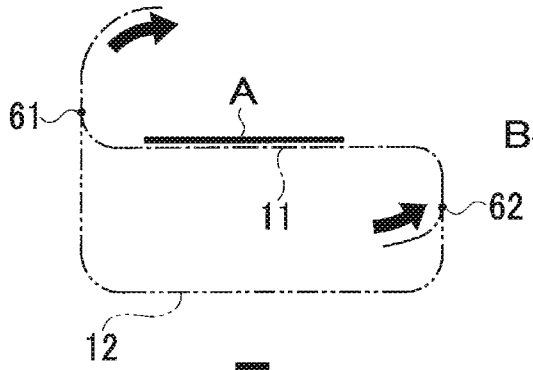
FIGS. 3A to 3E are explanatory views illustrating an example of the procedure of sheet conveyance using a system of conveying two sheets at once.
Figure 3D:
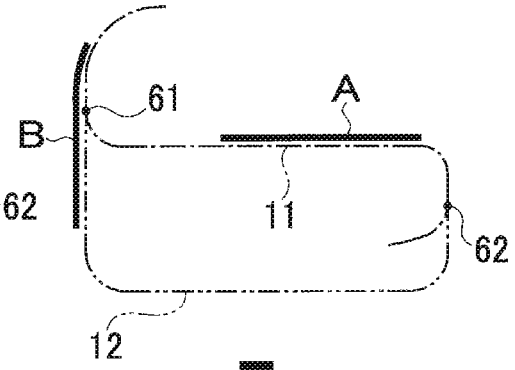
Figure 3B:
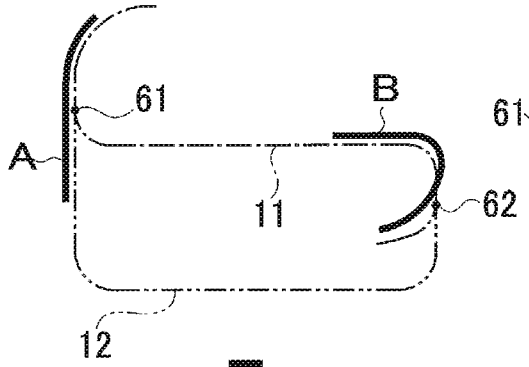
Figure 3E:
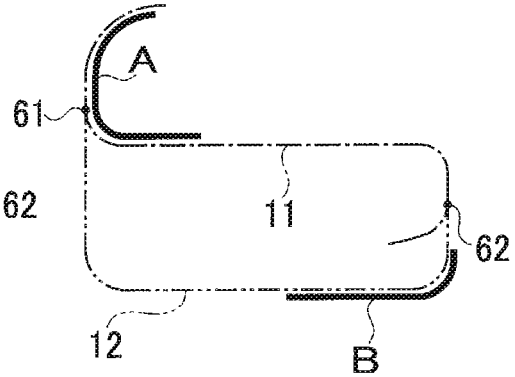
Figure 3C:
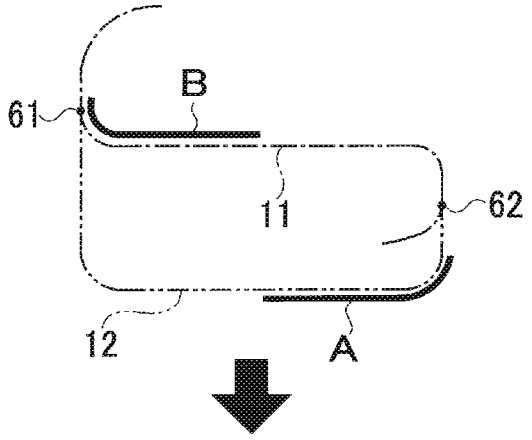

The system of conveying two sheets at once is a conveying system usable in a printing procedure in which after printing on one side of one sheet is performed, before printing on the other side is performed, printing on the next sheet is started. In double-sided printing using the system of conveying two sheets at once, for example, as shown in FIGS. 3A to 3E, the printer 100 performs printing on one side of a sheet A while conveying the first sheet A along the print path 11 (FIG. 3A). Subsequently, the printer 100 reverses the conveyance direction of the sheet A subjected to single-sided printing. Then, while conveying the sheet A to the joint point 62 along the reverse path 12, the printer feeds the next sheet B and conveys the sheet B along the print path 11 (FIGS. 3B to 3C). Subsequently, the printer 100 reverses the conveyance direction of the sheet B subjected to single-sided printing. Then, while conveying the sheet B to the joint point 62 along the reverse path 12, the printer conveys the sheet A conveyed along the reverse path 12, to the print path 11 (FIG. 3D). Thereafter, the printer 100 discharges the sheet A (FIG. 3E), and then discharges the sheet B.

In short, in the system of conveying two sheets at once, while conveying one sheet along the reverse path 12, the printer 100 conveys another sheet along the print path 11. In the system of conveying two sheets at once, since sheets are conveyed along the print path 11 and the reverse path 12, respectively, there is a timing when two sheets on which printing has not finished are simultaneously conveyed in the whole conveyance path including the print path 11 and the reverse path 12.

Further, in double-sided printing using conveyance of the system of conveying two sheets at once, after double-sided printing on both of a first sheet and a second sheet finishes, the printer 100 performs printing on a third sheet. Specifically, in the case of performing double-sided printing using conveyance of the system of conveying two sheets at once, the printer 100 performs printing in the order of one side of a first sheet (a second page), one side of a second sheet (a fourth page), the other side of the first sheet (a first page), the other side of the second sheet (a third page), and one side of a third sheet (a sixth page).

(3) System of Conveying Three Sheets at Once

Similarly to the system of conveying two sheets at once, the system of conveying three sheets at once is a conveying system usable in a printing procedure in which after printing on one side of one sheet is performed, before printing on the other side is performed, printing on the next sheet is started. However, in the system of conveying three sheets at once, after double-sided printing is performed on the other side of a first sheet by the system of conveying two sheets at once, before double-sided printing is performed on the other side of a second sheet, the printer 100 feeds a third sheet.

Figure 4A:
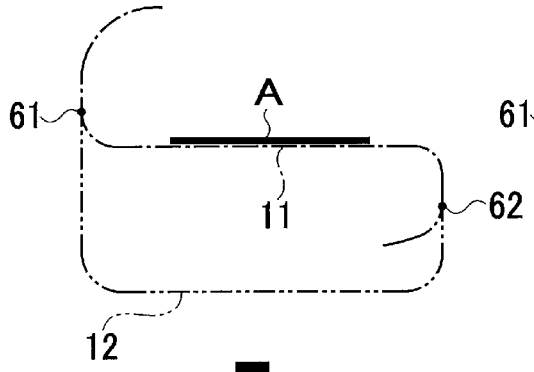
FIGS. 4A to 4F are explanatory views illustrating an example of the procedure of sheet conveyance using a system of conveying three sheets at once.
Figure 4D:
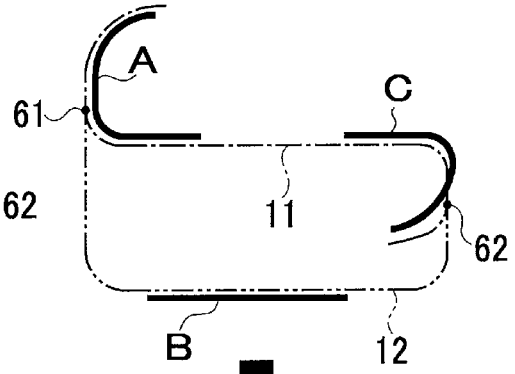
Figure 4B:
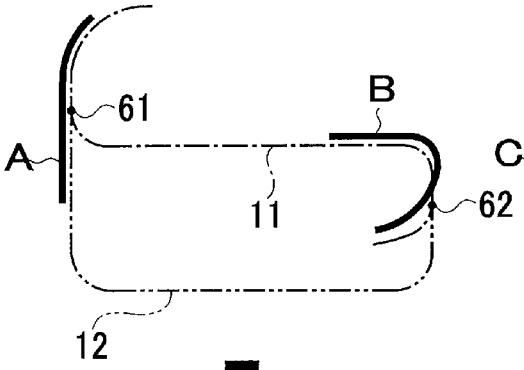
Figure 4E:
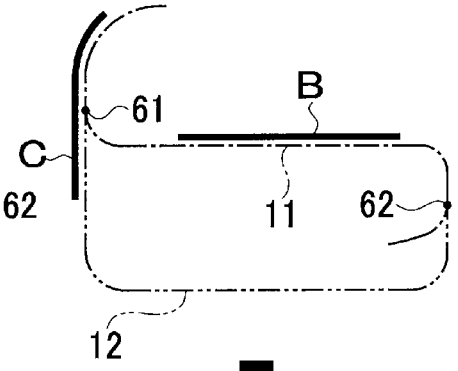
Figure 4C:
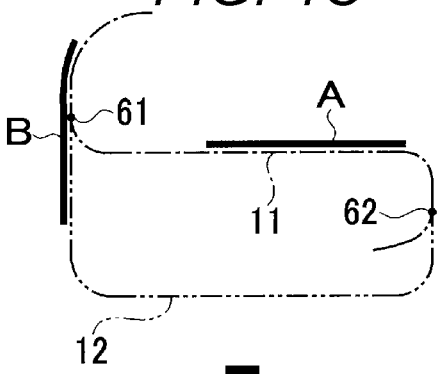

In double-sided printing using the system of conveying three sheets at once, for example, as shown in FIGS. 4A to 4F, the printer 100 performs printing on one side a first sheet A while conveying the first sheet along the print path 11 (FIG. 4A). Subsequently, while conveying the sheet A having one printed side along the reverse path 12, the printer 100 feeds the next sheet B and conveys the sheet B along the print path 11 (FIG. 4B). Then, while reversing the sheet B and conveys along the reverse path 12, the printer 100 conveys the sheet A along the print path 11 (FIG. 4C).

Figure 4F:
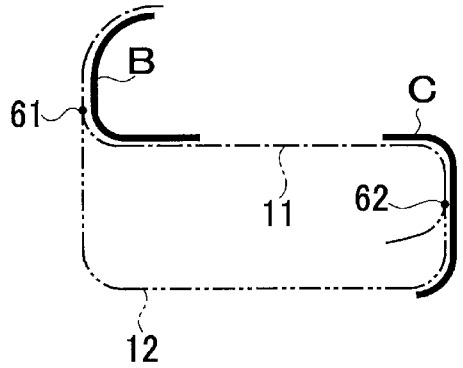

Further, while conveying the sheet B along the reverse path 12, the printer 100 discharges the sheet A having two printed sides, and feeds a third sheet C (FIG. 4D). Subsequently, while conveying the sheet C having one printed side along the reverse path 12, the printer 100 conveys the sheet B along the print path 11 (FIG. 4E). Then, while discharging the sheet B discharges the sheet B having two printed sides, the printer 100 conveys the third sheet C along the print path 11 (FIG. 4F).

In short, in the system of conveying three sheets at once, while conveying the second sheet along the reverse path 12, the printer 100 conveys the first sheet and the third sheet along the print path 11. In the system of conveying three sheets at once, while one sheet is conveyed along the reverse path 12, two sheets are conveyed along the print path 11. Therefore, there is a timing when three sheets on which printing has not finished are simultaneously conveyed in the whole conveyance path including the print path 11 and the reverse path 12. If the reverse path 12 of the printer 100 is longer than the print path 11, and the length of the reverse path in the sheet conveyance direction is within a predetermined range, the printer 100 can convey sheets by the system of conveying three sheets at once.

Further, in double-sided printing using conveyance of the system of conveying three sheets at once, after double-sided printing on all of three sheets finishes, the printer 100 performs printing on a fourth sheet. Specifically, in the case of performing double-sided printing using conveyance of the system of conveying three sheets at once, the printer 100 performs printing in the order of one side of a first sheet (a second page), one side of a second sheet (a fourth page), the other side of the first sheet (a first page), one side of a third sheet (a sixth page), the other side of the second sheet (a third page), the other side of the third sheet (a fifth page), and the other side of a fourth sheet (an eighth page).

In the system of conveying two sheets at once, the printer 100 simultaneously conveys two sheets along the path composed of the print path 11 and the reverse path 12. Therefore, the number of sheets which are simultaneously conveyed by the system of conveying one sheet at once is smaller than that that of the system of conveying two sheets at once. In other words, a conveying process using the system of conveying two sheets at once is an example of a first conveying process, and the system of conveying one sheet at once is an example of a second conveying process. In the system of conveying three sheets at once, the printer 100 simultaneously conveys three sheets the path composed of the print path 11 and the reverse path 12. Therefore, the number of sheets which are simultaneously conveyed by the system of conveying two sheets at once is smaller than that that of the system of conveying three sheets at once. In other words, a conveying process using the system of conveying three sheets at once is an example of the first conveying process, and the system of conveying two sheets at once or the system of conveying one sheet at once is an example of the second conveying process.

The sheet conveyance speed of the printer 100 is a speed based on the printing speed of the processing unit 5 and so on. While feeding a sheet, and performing printing on one side of the sheet, and conveying the sheet along the reverse path 12, and performing printing on the other side, and discharging the sheet, the printer 100 does not change the conveyance speed of the sheet and does not stop conveying the sheet. Further, since the path length of the reverse path 12 is fixed, the time required to convey a sheet along the reverse path 12 is a fixed time. In the system of conveying two sheets at once or the system of conveying three sheets at once, for the above-mentioned fixed time, the printer 100 conveys one or two sheets in the processing unit 5. Therefore, in the system of conveying two sheets at once, there is a section in which the interval between sheets is shorter than that in the system of conveying one sheet at once, and in the system of conveying three sheets at once, there is a section in which the interval between sheets is shorter than that in the system of conveying two sheets at once.

The heating roller 81 of the fixing unit 8 fixes toner to sheets, thereby losing heat to the sheets and the toner. Therefore, the temperature of the surface of the heating roller 81 lowers due to passage of each sheet. The printer 100 performs supply of power to the heater 811 when the temperature of the surface of the heating roller 81 lowers, thereby heating the heating roller 81. However, for example, in the case where the interval between sheets is short, the temperature may not completely recover until the next sheet arrives when the temperature lowers due to passage of a preceding sheet. In other words, in a state where a temperature margin which is the difference between the temperature of the surface of the heating roller 81 and the fixing temperature is not large, in the case of starting consecutive printing using a conveying system in which the number of sheets which are simultaneously conveyed is large, when the following sheet arrives, the temperature of the surface of the heating roller 81 may be lower than the fixing temperature.

In order to suppress fixing failure, for example, it can be considered to set the temperature of the surface of the heating roller 81 which is one of conditions for starting consecutive printing using the system of conveying two sheets at once or the system of conveying three sheets at once to a temperature higher than a temperature for starting printing operations using the system of conveying one sheet at once. However, in the case where a print job is received when the temperature of the surface of the heating roller 81 is low, if printing does not start until the temperature of the surface becomes higher than the start condition of the system of conveying one sheet at once is set, in the system of conveying two sheets at once or the system of conveying three sheets at once, the time from when a job is received to when a first printed sheet is output becomes longer than that in the system of conveying one sheet at once. On the other hand, the system of conveying two sheets at once has an advantage of being able to perform printing on more sheets per unit time as compared to the system of conveying one sheet at once, and the system of conveying three sheets at once can perform printing on more sheets as compared to the system of conveying two sheets at once.

For example, toner images including header images or photo images may have some parts where the amounts of toner required to be fixed are large. In the case of starting consecutive printing in a state where the temperature margin which is the difference between the temperature of the surface of the heating roller 81 and the fixing temperature is not large, if fixing of a toner image of an image having some parts where the amounts of toner required to be fixed are large is performed when the temperature of the surface of the heating roller 81 is lower than the fixing temperature, fixing failure may occur. Meanwhile, in the case of fixing a toner image in which the amount of toner is not large, even though the temperature of the surface of the heating roller 81 is lower than the fixing temperature, fixing failure is unlikely to occur. Therefore, the printer 100 of the present aspect estimates the amounts of toner of toner images required to be fixed, on the basis of image data, and determines a sheet conveying system.

Figure 5:
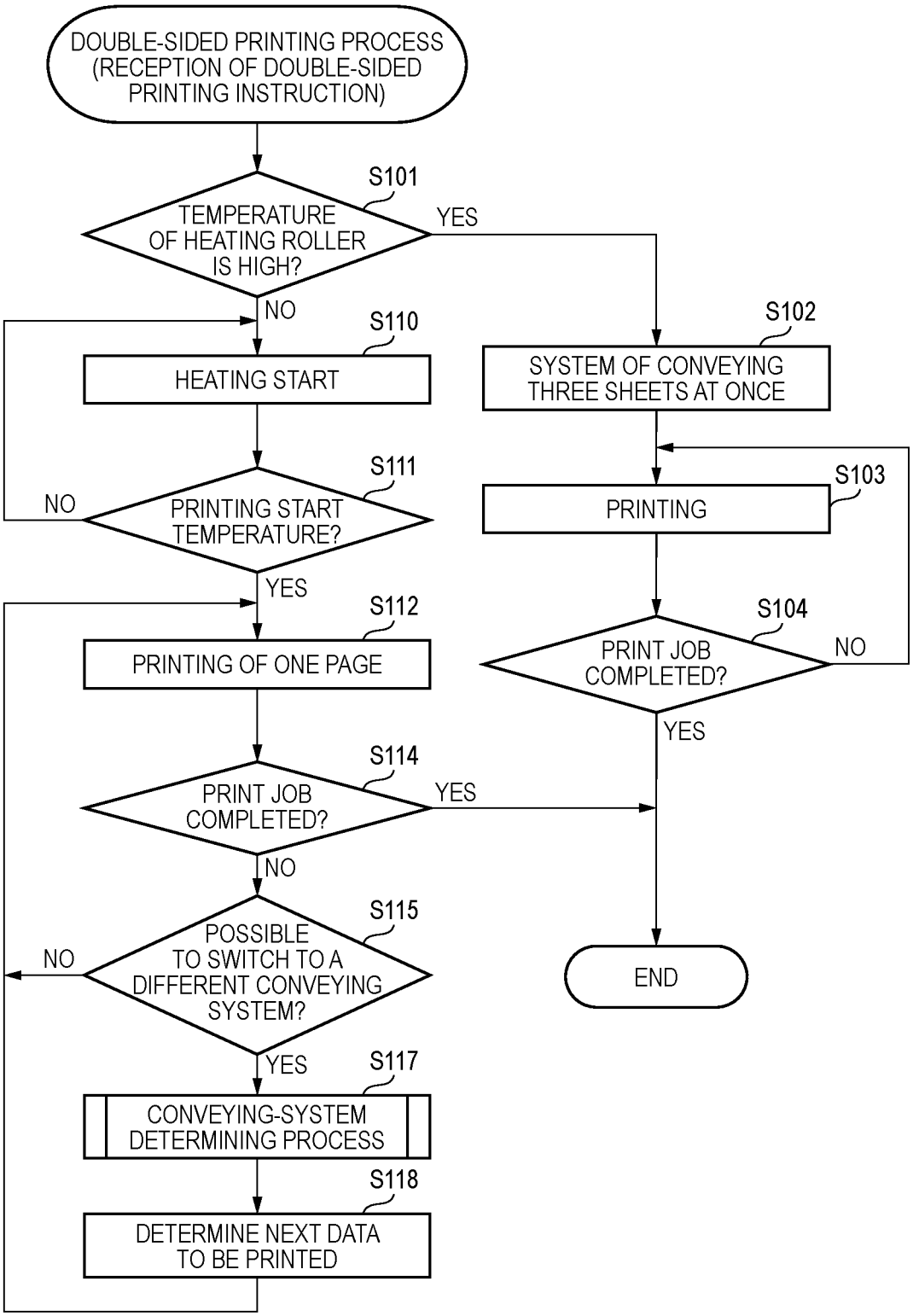
FIG. 5 is a flow chart illustrating the procedure of a double-sided printing process.

Hereinafter, the procedure of a double-sided printing process of implementing an operation of performing a print job of double-sided printing which is performed in the printer 100 of the present aspect will be described with reference to the flow chart of FIG. 5. This double-sided printing process is performed by the CPU 31 when a print job which is a printing instruction of double-sided printing of a plurality of pages is received. For example, the printer 100 may receive a print job from the outside via the network IF 37 or the USB-IF 38, or may receive a print job via the operation panel 40. A process of receiving a printing instruction of double-sided printing to cause the printer to perform the double-sided printing process is an example of a receiving process.

In the double-sided printing process, first, the CPU 31 determines whether the temperature of the surface of the heating roller 81 is sufficiently high (step S101). In the case of determining that the temperature of the surface of the heating roller 81 is sufficiently high ("YES" in step S101), since the temperature margin is large, the CPU 31 determines to use the system of conveying three sheets at once (step S102).

Specifically, in step S101, for example, in the case where the temperature of the surface of the heating roller 81 acquired on the basis of the output signal of the temperature sensor 812 exceeds a threshold temperature, the CPU 31 determines that the temperature of the surface is high. The threshold temperature is a temperature higher than the fixing temperature, and is a temperature having a large temperature margin. Meanwhile, for example, in the case where the temperature of the surface of the heating roller 81 acquired on the basis of the output signal of the temperature sensor 812 does not exceed a threshold temperature, the CPU 31 determines that the temperature of the surface is not high. For example, in the case where the elapsed time from performance of the previous print job does not exceed a threshold time, the CPU 31 determines that the temperature of the surface is high. The threshold time is an estimate of the time required to secure a temperature having a large temperature margin after stopping temperature control on the temperature of the surface of the heating roller 81.

When the temperature of the heating roller 81 is sufficiently high, whatever system is used to perform double-sided printing, the possibility that fixing will be properly performed is high. Therefore, the system of conveying three sheets at once which is a conveying system of performing printing on a large number of sheets per unit time can be used. In this case, it is possible to perform higher-speed double-sided printing. Since it is not necessary to delay start of conveyance, it does not take a long time to output a first printed sheet after reception of a job.

Subsequently, the CPU 31 performs control such that the conveying unit conveys sheets by the system of conveying three sheets at once and the processing unit 5 performs printing (step S103). Further, the CPU 31 determines whether printing of the received print job has been completed (step S104). In the case of determining that printing has not been completed ("NO" in step S104), the CPU 31 performs control such that printing continues. Meanwhile, in the case of determining that printing of the print job has been completed ("YES" in step S104), the CPU 31 finishes the double-sided printing process.

Meanwhile, in the case of determining that the temperature of the surface of the heating roller 81 is not sufficiently high ("NO" in step S101), the CPU 31 performs control such that supply of power to the heater 811 is started, whereby the heating roller 81 is heated (step S110). For example, in the case where the operation mode of the printer 100 is a sleep mode in which temperature control on the heating roller 81 is stopped, or immediately after activation of the printer 100, the CPU 31 determines that the temperature of the surface of the heating roller 81 is not sufficiently high, and performs control such that heating of the heating roller 81 is started.

Subsequently, the CPU 31 determines whether the temperature of the surface of the heating roller 81 has reached a predetermined printing start temperature (step S111). The printing start temperature is the temperature of the surface of the heating roller 81 suitable for fixing. Instead of performing determination using the printing start temperature, for example, the CPU 31 may perform determination on the basis of whether a predetermined time has elapsed after the temperature of the surface of the heating roller reached the fixing temperature, or may perform determination on the basis of the heating time after start of heating. Even after the temperature of the surface of the heating roller 81 reaches the printing start temperature, the CPU 31 controls supply of power to the heater 811 such that the temperature of the surface falls within a predetermined temperature range. In the case of determining that the temperature of the surface of the heating roller 81 has not reached the printing start temperature ("NO" in step S111), the CPU 31 further performs control such that heating of the heating roller 81 is continued.

In the case of determining that the temperature of the surface of the heating roller 81 has reached the printing start temperature ("YES" in step S111), the CPU 31 first performs control such that an image of one page is printed on one side of a sheet (step S112). The page which the printer 100 prints for the first time is a second page in every conveying system. In other words, the CPU 31 performs control such that the conveying unit conveys one sheet and the processing unit 5 performs printing based on image data of the second page. Further, the CPU 31 determines whether printing of the received print job has been completed (step S114).

In the case of determining that printing of the received print job has not been completed ("NO" in step S114), the CPU 31 determines whether it is a timing when it is possible to switch to a different conveying system (step S115). A timing when it is possible to switch to a different conveying system is a timing when the next pages to be printed by the conveying systems are different, and, for example, a timing immediately after the second page is printed is one of timings when it is possible to switch to a conveying system. Another one of timings when it is possible to switch to a different conveying system is a timing immediately after printing on a third print side (a first page) is performed by the system of conveying two sheets at once or the system of conveying three sheets at once. Further, in the system of conveying three sheets at once, a timing immediately after a fifth print side (a third page) is printed may be a timing when it is possible to switch to a different conveying system.

In the case of determining that it is not a timing when it is possible to switch to a different conveying system ("NO" in step S115), the CPU 31 proceeds to step S112, and performs control such that printing of an image of the next page according to the order of printing of the current conveying system is performed. Meanwhile, in the case of determining that it is a timing when it is possible to switch to a different conveying system ("YES" in step S115), the CPU 31 performs a conveying-system determining process (step S117).

Figure 6:
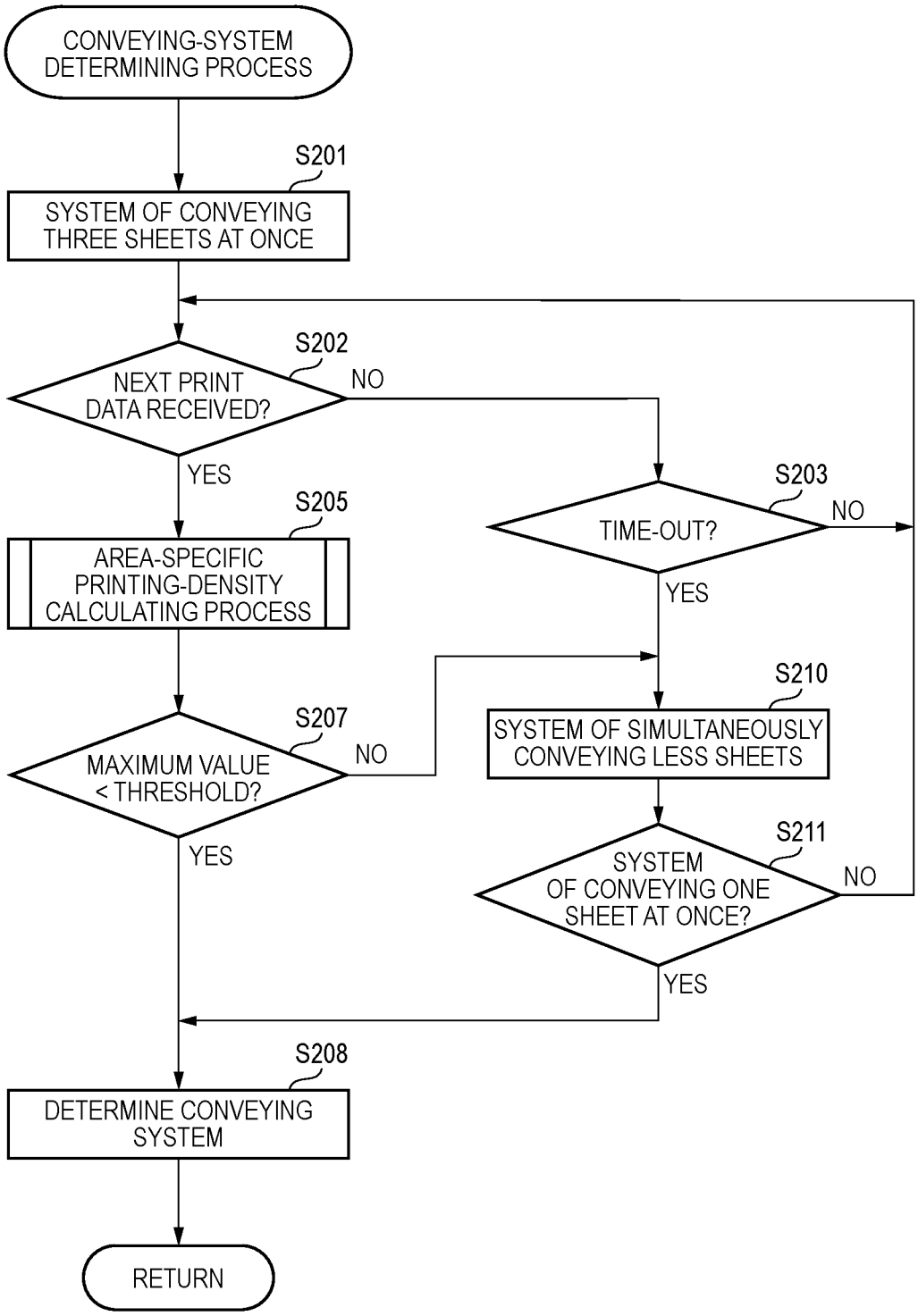
FIG. 6 is a flow chart illustrating the procedure of a conveying-system determining process.

Now, the procedure of the conveying-system determining process will be described with reference to the flow chart of FIG. 6. In the conveying-system determining process, the CPU 31 first selects, for example, the system of conveying three sheets at once (step S201). Subsequently, the CPU 31 determines whether print data of the next page to be printed has been received (step S202). For example, in the case where the conveying-system determining process was started after printing of a second page, since the next page to be printed after the second page by the system of conveying three sheets at once is a fourth page, the CPU 31 determines whether data of the fourth page has been received.

In the case of determining that the next print data has not been received ("NO" in step S202), the CPU 31 determines whether a time-out has occurred (step S203). In the case of determining that a time-out has not occurred ("NO" in step S203), the CPU 31 continues to wait for print data to be input. Meanwhile, before a time-out occurs, when it is determined that the print data of the next page to be printed has been received ("YES" in step S202), the CPU 31 performs an area-specific printing-density calculating process (step S205).

Figure 7:
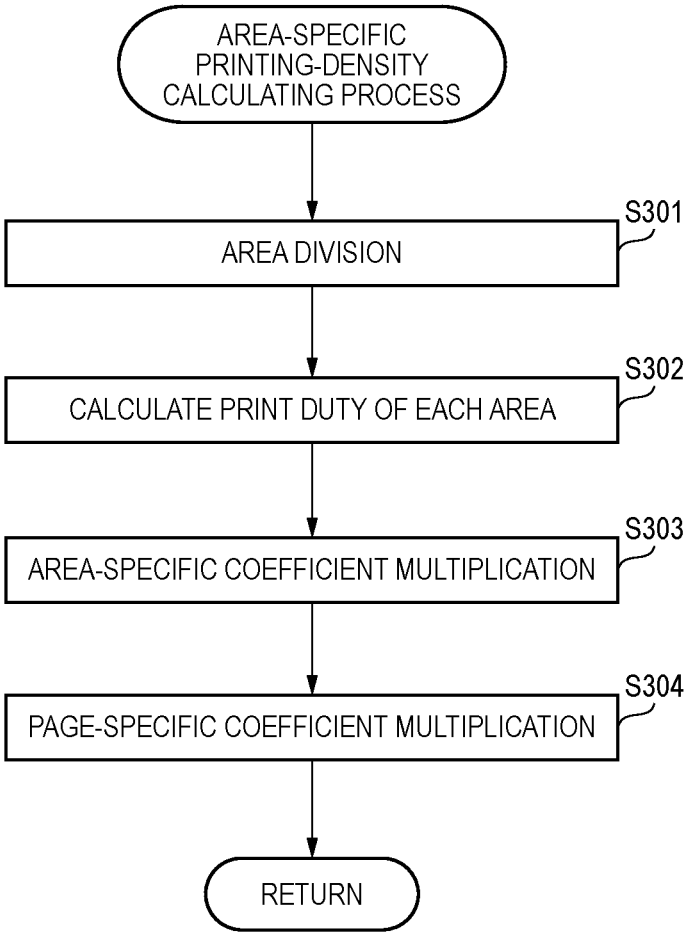
FIG. 7 is a flow chart illustrating the procedure of an area-specific printing-density calculating process.

Now, the procedure of the area-specific printing-density calculating process will be described with reference to the flow chart of FIG. 7. The CPU 31 first divides image data of one page into a plurality of areas (step S301). Specifically, the CPU 31 divides image data into, for example, 56 areas by dividing the image data into 8 parts in the sheet conveyance direction and dividing the image data into 7 parts in a direction perpendicular to the sheet conveyance direction, as shown in FIG. 8. In this example, the total number of divided areas in the image data of one page is 56.

Subsequently, for each area, the CPU 31 calculates the print duty of the corresponding area (step S302). The print duty of each area is the average density of the corresponding area, and is obtained as a percentage density. The print duty of each area is an example of an amount related to the amount of toner per unit area. For example, the CPU 31 may calculate a dot count which is the number of dots of print data corresponding to each area, as the print duty, regardless of colors. Alternatively, for example, the CPU 31 may calculate the product of a dot count and the emission intensity of the LED type exposing device, as a print duty.

Subsequently, the CPU 31 multiplies the calculated print duty of each area by an area-specific coefficient (step S303). Area-specific coefficients are weighting coefficients which are set for the individual areas, respectively, for example, as shown in FIG. 8, and are determined in advance and are stored in the ROM 32 or the NVRAM 34. The area-specific coefficients depend on the conveying systems. The example shown in FIG. 8 is an example in the case of the system of conveying three sheets at once, and numeric values written in individual sections are examples of area-specific coefficients of the corresponding areas. A result obtained by multiplying a print duty by an area-specific coefficient is an amount calculated by giving an area-specific weight to the print duty, and is an example of a specific amount.

The influence of lowering of the temperature of the surface of the heating roller 81 depends on the positions of the areas. Therefore, by giving weights to the areas, respectively, it is possible to more appropriately perform determination of a conveying system. The area-specific coefficients need to be set such that the area-specific coefficients of areas at the rear end side of each sheet in the conveyance direction are larger than those of areas at the front end side, for example, as shown in FIG. 8. Since the heating roller 81 is deprived of heat from the front end side which first comes into contact with sheets and toner, the areas of the front end side are likely to be influenced by lowering of the temperature of the surface of the heating roller 81. Therefore, by setting larger weights for the areas of the front end side, it is possible to more appropriately determine whether it is possible to secure fixing strength.

The area-specific coefficients need to be set such that in a direction perpendicular to the sheet conveyance direction, the area-specific coefficients of areas of the end sides are larger than those of areas of the center side. The end sides of the heating roller 81 in the width direction are more likely to lack heat, as compared to the center side, and are likely to be influenced by lowering of the temperature of the surface of the heating roller 81. Therefore, by setting larger weights for the areas of the end sides, it is possible to more appropriately determine whether it is possible to secure fixing strength.

Subsequently, the CPU 31 multiplies the results obtained by multiplying the print duties by the area-specific coefficients, by each page-specific coefficient (step S304). Page-specific coefficients are weighting coefficients set for pages, respectively, for example, as shown in FIG. 9, and are determined in advance and are stored in the ROM 32 or the NVRAM 34. Numbers written in the left sections of FIG. 9 are the numbers of print pages according to the conveyance order. Page-specific coefficients also depend on the conveying systems. The example shown in FIG. 9 is an example of the case of the system of conveying three sheets at once. Results obtained by multiplying the print duties by a page-specific coefficient are amounts obtained by giving a page-specific weight to the print duties, and are examples of the specific amount.

The influence of lowering of the temperature of the surface of the heating roller 81 depends on the pages. Therefore, by giving weights to the pages, respectively, it is possible to more appropriately perform determination of a conveying system. The page-specific coefficients are set such that the coefficient for the second page is larger than the coefficients of the other pages and the coefficients for the third page and the subsequent pages sequentially decrease, for example, as shown in FIG. 9. In the case where the temperature margin during start of printing is small, especially, printing of the second page tends to be likely to be influenced by lowering of the temperature of the surface of the heating roller 81. Therefore, by setting a large coefficient for the second page, it is possible to more appropriately determine whether it is possible to secure fixing strength.

Hereinafter, the conveying-system determining process of FIG. 6 will be further described. After the area-specific printing-density calculating process of step S205, the CPU 31 determines whether the maximum value of the calculation results of the individual areas obtained by the area-specific printing-density calculating process is smaller than a predetermined threshold (step S207). The threshold is an example of a predetermined amount. In the case of determining that the maximum value is smaller than the threshold ("YES" in step S207), the CPU 31 determines the conveying system applied to the area-specific printing-density calculating process of step S205, as a conveying system (step S208), and finishes the conveying-system determining process.

For example, in the case of selecting the system of conveying three sheets at once in step S201 and then performing the area-specific printing-density calculating process using the area-specific coefficients and the like of the system of conveying three sheets at once, when the determination result of step S207 is "YES", in step S208, the CPU 31 determines the system of conveying three sheets at once. When an image of one page is divided to a plurality of areas, and any one of the calculation results of the areas is equal to or larger than the threshold, conveyance using the conveying system applied to calculation is not performed, and another conveying system capable of securing fixing strength is determined.

Meanwhile, in the case of determining that the maximum value is not smaller than the threshold ("NO" in step S207), or in the case of determining that a time-out has occurred in step S203 ("YES" in step S203), the CPU 31 selects a conveying system of simultaneously conveying less sheets at once as compared to the conveying system having been selected (step S210). For example, the CPU 31 performs switching from the system of conveying three sheets at once to the system of conveying two sheets at once. For example, when the system of conveying two sheets at once has been selected, the CPU 31 performs switching from the system of conveying two sheets at once to the system of conveying one sheet at once. Subsequently, the CPU 31 determines whether the selected conveying system is the system of conveying one sheet at once (step S211).

In the case of determining that the system of conveying one sheet at once has been selected ("YES" in step S211), the CPU 31 determines the selected conveying system (step S208), and finishes the conveying-system determining process. Since there is no conveying system of simultaneously conveying less sheets at once as compared to the system of conveying one sheet at once, in the case where the system of conveying one sheet at once has been selected, the CPU 31 determines the system of conveying one sheet at once, as a conveying system.

In the case of determining that the system of conveying one sheet at once has not been selected ("NO" in step S211), i.e. when the selected system is the system of conveying two sheets at once, the CPU 31 returns to step S202, and determines whether print data of the next page to be printed by the system of conveying two sheets at once has been received. Even in the system of conveying two sheets at once, a page to be printed next to the second page is the fourth page. Therefore, even in this case, the CPU 31 determines whether data of the fourth page has been received.

Subsequently, the CPU 31 performs an area-specific printing-density calculating process with respect to the system of conveying two sheets at once (step S205). This area-specific printing-density calculating process is the same process as the process described above with respect to the system of conveying three sheets at once, except that as shown in FIG. 10 and FIG. 11, area-specific coefficients and page-specific coefficients of the system of conveying two sheets at once are different from the coefficients of the system of conveying three sheets at once.

Specifically, in the system of conveying two sheets at once, coefficients specific to some areas are smaller than the area-specific coefficients of the system of conveying three sheets at once. As described above, in the system of conveying three sheets at once, there is a section in which the interval between sheets is shorter than that in the system of conveying two sheets at once. In the printer 100, since the area-specific coefficients of the system of conveying three sheets at once are set to be larger than the area-specific coefficients of the system of conveying two sheets at once, it is possible to suppress occurrence of fixing failure. Therefore, even in the case where it is determined in step S207 that the maximum value based on the system of conveying three sheets at once is equal to or larger than the threshold ("NO"), the maximum value based on the system of conveying two sheets at once may be smaller than the threshold. Therefore, in the case of determining "YES" in step S207, the CPU 31 determines the system of conveying two sheets at once.

Hereinafter, the double-sided printing process of FIG. 5 will be further described. Since the conveying system has been determined in the conveying-system determining process of step S117, the CPU 31, and determines print data of the next gage to be printed by conveying a sheet by the determined conveying system (step S118). Then, the CPU 31 returns to step S112, and performs printing of one page. Further, the CPU 31 determines whether printing of the print job has been completed, and when it is determined that printing has been completed, the CPU finishes the double-sided printing process.

As described above in detail, the printer 100 of the first aspect has three conveying systems, and determines a conveying system to be used to perform double-sided printing on a plurality of sheets according to amounts calculated with respect to a toner image which is the next fixing object and related to the amount of toner per unit area. The temperature of the surface of the heating roller 81 required for fixing depends on the contents of images. In other words, header images and high-density areas similar to them require high fixing temperature; whereas low-density areas like text images require low fixing temperature. The printer 100 obtains the print duties of individual areas with respect to the next image data to be printed, and multiplies the print duties by area-specific coefficients and a page-specific coefficient, and determines a conveying system on the basis of the multiplication results.

For example, in the case where the maximum value of the calculation results of the individual areas is smaller than the threshold, even though a conveying system of processing a large number of sheets per unit time is used, fixing strength is likely to be secured. Therefore, the printer performs printing by the conveying system of processing a large number of sheets per unit time, such that productivity improves. For example, in the case where the maximum value of the calculation results of individual areas is equal to or larger than the threshold, when a conveying system of processing a large number of sheets per unit time is used, fixing strength is unlikely to be secured. For this reason, the printer performs printing by a conveying system of processing a small number of sheets per unit time, such that fixing quality is secured. Further, since the printer 100 determines a conveying system whenever it is possible to switch to a different conveying system, while securing fixing quality, it is possible to suppress a decrease in the productivity.

A second aspect of the image forming apparatus according to the present disclosure will be described in detail with reference to the accompanying drawings. The present aspect is a printer 100 having the same configuration as that of the first aspect, and the printer 100 performs an operation different from that of the first aspect. The printer 100 of the second aspect is different from the first aspect in that it determines a conveying system before starting printing and does not switch to a different conveying system while performing the procedure of printing by the determined conveying system. In other words, in the case of determining to use the system of conveying two sheets at once, the printer does not change the conveying system until finishing double-sided printing on two sheets. In the case of determining to use the system of conveying three sheets at once, the printer does not change the conveying system until finishing double-sided printing on three sheets. Hereinafter, components and processes identical to those of the first aspect are denoted by the same reference symbols, and a description thereof will not be made.

Figure 12:
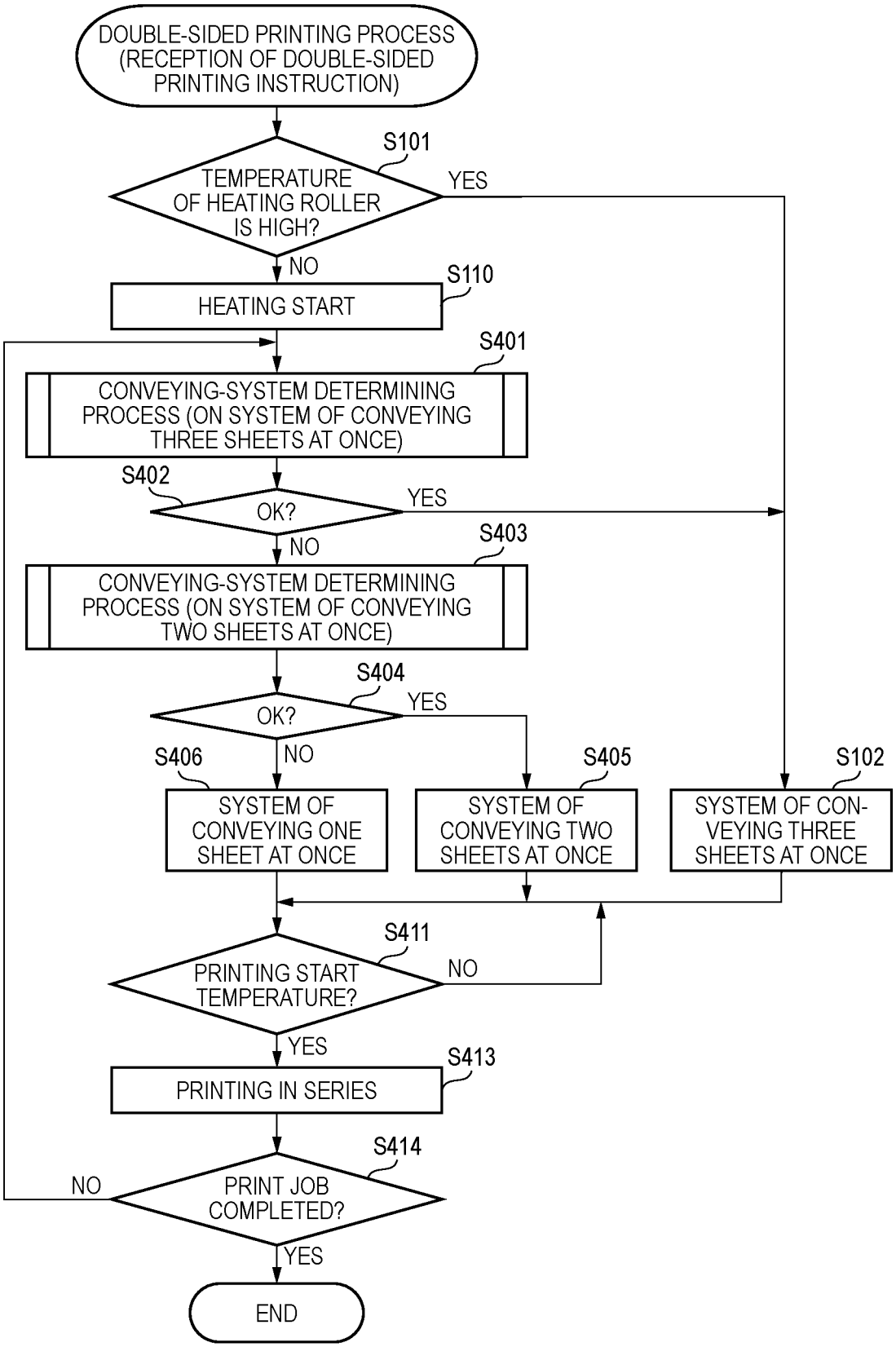
FIG. 12 is a flow chart illustrating the procedure of a double-sided printing process.

The procedure of a double-sided printing process of implementing an operation of performing a print job of double-sided printing which is performed in the printer 100 of the present aspect will be described with reference to the flow chart of FIG. 12. This double-sided printing process is performed by the CPU 31 when a print job which is a printing instruction of double-sided printing of a plurality of pages is received.

In the double-sided printing process, first, the CPU 31 determines whether the temperature of the surface of the heating roller 81 is sufficiently high (step S101). In the case of determining that the temperature of the surface of the heating roller 81 is sufficiently high ("YES" in step S101), the CPU 31 determines to use the system of conveying three sheets at once (step S102).

Meanwhile, in the case of determining that the temperature of the surface of the heating roller 81 is not sufficiently high ("NO" in step S101), the CPU 31 performs control such that supply of power to the heater 811 is started, whereby the heating roller 81 is heated (step S110). Subsequently, the CPU 31 performs a conveying-system determining process of determining whether to use conveyance of the system of conveying three sheets at once (determination on the system of conveying three sheets at once) (step S401).

Figure 13:
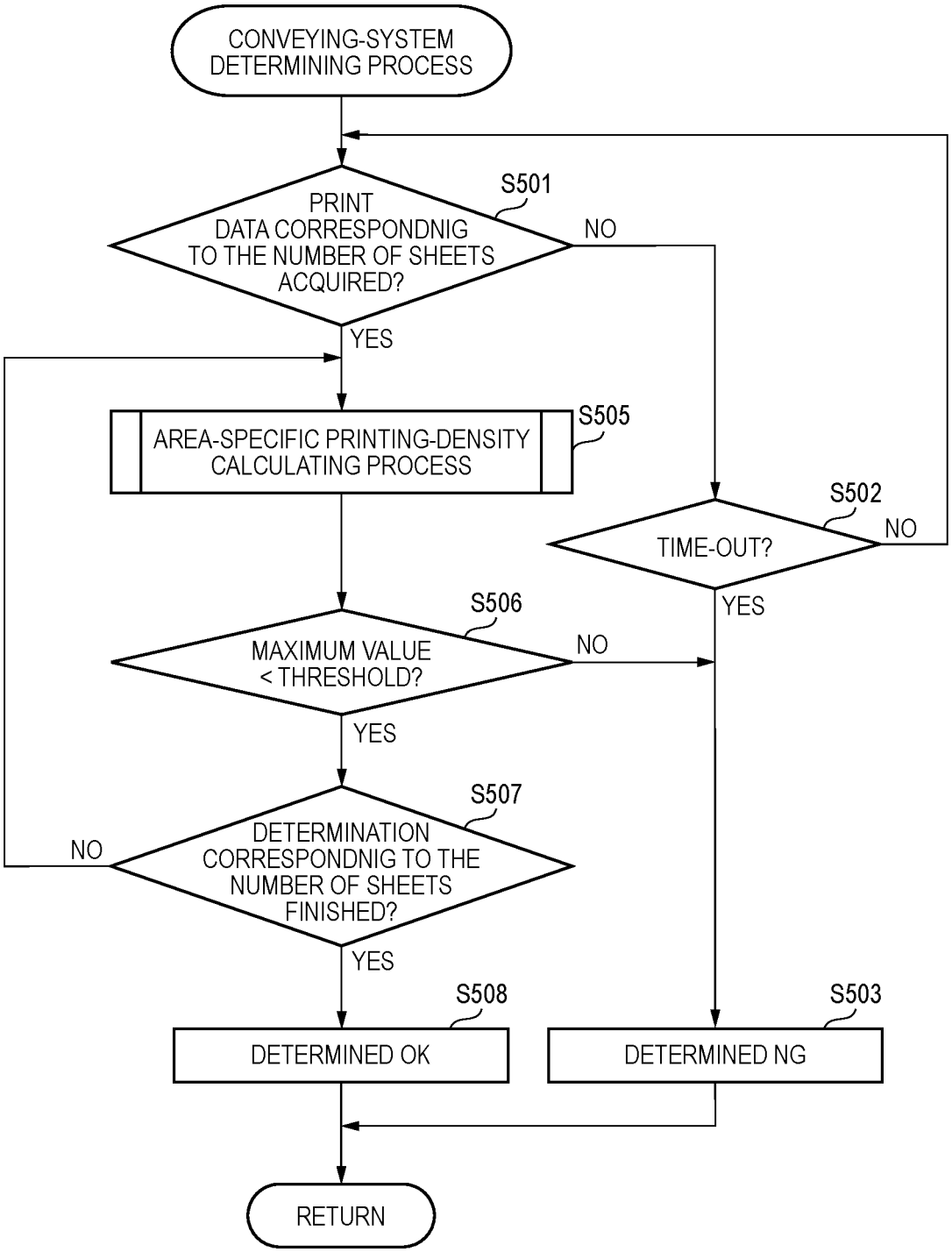
FIG. 13 is a flow chart illustrating the procedure of a conveying-system determining process.

The procedure of the conveying-system determining process will be described with reference to the flow chart of FIG. 13. In the conveying-system determining process, the CPU 31 first determines whether print data corresponding to the number of sheets necessary for the procedure of a conveying operation has been acquired (step S501). In the case of performing determination on the system of conveying three sheets at once, the CPU 31 determines whether print data corresponding to six sides of three sheets has been acquired. In the case of performing determination on the system of conveying two sheets at once, the CPU 31 determines whether print data corresponding to four sides of two sheets has been acquired.

In the case of determining that the required print data has not been acquired ("NO" in step S501), the CPU 31 determines whether a time-out has occurred (step S502). In the case of determining that a time-out has not occurred ("NO" in step S502), the CPU 31 returns to step S501, and re-determines whether print data has been acquired.

In the case of determining that a time-out has occurred ("YES" in step S502), the CPU 31 determines that it is NG (step S503). In other words, in determination on the system of conveying three sheets at once, in the case where it is impossible to acquire print data corresponding to three sheets necessary for the procedure of a conveying operation, the CPU 31 determines not to use the system of conveying three sheets at once. In determination on the system of conveying two sheets at once, in the case where it is impossible to acquire image data corresponding to two sheets necessary for the procedure of a conveying operation, the CPU 31 determines not to use the system of conveying two sheets at once.

In the case of determining that image data has been acquired ("YES" in step S501), the CPU 31 performs an area-specific printing-density calculating process with respect to print data corresponding to one page (step S505). This area-specific printing-density calculating process is identical to the process which is performed in step S205 of the conveying-system determining process of the first aspect and has been described with reference to FIG. 7. Subsequently, the CPU 31 determines whether the maximum value of calculated printing densities is smaller than a predetermined threshold (step S506). Although step S506 is a process identical to step S207 of the conveying-system determining process of the first aspect, the threshold may be set to be different from that of the first aspect.

In the case of determining that the maximum value of the printing densities is not smaller than the predetermined threshold ("NO" in step S506), the CPU 31 determines that it is NG (step S503). In the case where any area having a printing density equal to or larger than the threshold is included, it is better not to perform conveyance using the conveying system which is the determination object.

Meanwhile, in the case of determining that the maximum value of the printing densities is smaller than the predetermined threshold ("YES" in step S506), the CPU 31 determines whether determination has finished with respect to the print data corresponding to the number of sheets required for the process of a conveying operation (step S507). In the case of determining that determination has not finished ("NO" in step S507), the CPU 31 performs the area-specific printing-density calculating process of step S505 with respect to the print data of the next page, and determines whether the maximum value is smaller than the threshold, in step S506.

In the case of determining that determination has finished with respect to the print data corresponding to the number of sheets required for the procedure of a conveying operation ("YES" in step S507), the CPU 31 determines that it is OK to perform conveyance by the conveying system which is the determination object (step S508), and finishes the conveying-system determining process.

Hereinafter, the double-sided printing process of FIG. 12 will be further described. The CPU 31 determines whether it has been determined in step S401 that it is OK to use the system of conveying three sheets at once (step S402). In the case of determining that it is OK ("YES" in step S402), the CPU 31 determines to use the system of conveying three sheets at once (step S102).

Meanwhile, in the case of determining that it is NG ("NO" in step S402), the CPU 31 performs a conveying-system determining process (on the system of conveying two sheets at once) which is determination on the system of conveying two sheets at once (step S403). Then, the CPU determines whether the determination result of the conveying-system determining process performed with respect to the system of conveying two sheets at once is that it is OK (step S404). In the case of determining that it is OK ("YES" in step S404), the CPU 31 determines to use the system of conveying two sheets at once (step S405). In the case of determining that it is NG ("NO" in step S404), the CPU 31 determines to use the system of conveying one sheet at once (step S406)

After performing step S102, step S405 or step S406, the CPU 31 determines whether the temperature of the surface of the heating roller 81 has reached a predetermined printing start temperature (step S411). In the case of determining that the temperature of the surface has not reached the printing start temperature ("NO" in step S411), the CPU 31 performs control such that heating of the heating roller 81 is continued until the temperature of the surface reaches the printing start temperature.

Thereafter, in the case of determining that the temperature of the surface has reached the printing start temperature ("YES" in step S411), the CPU 31 performs control such that the procedure of double-sided printing is performed by the conveying system determined before (step S413). Then, the CPU 31 determines whether printing of the received print job has been completed (step S414). In the case of determining that printing has not been completed ("NO" in step S414), the CPU 31 returns to step S401, and determines a conveying system for the procedure of next printing. Meanwhile, in the case where the system of conveying three sheets at once has been already determined, since the possibility that it is possible to continuously use the system of conveying three sheets at once is high, the printer may continue printing by the system of conveying three sheets at once, without performing determination again. In the case of determining that printing of the print job has been completed ("YES" in step S414), the CPU 31 finishes the double-sided printing process.

As described above in detail, even according to the printer 100 of the second aspect, while securing fixing quality, it is possible to suppress a decrease in the productivity. In the second aspect, although printing densities are checked with respect to every page to be an object of the procedure of a printing operation, the checking of the printing density may not be performed on every page. For example, with respect to a page to be printed first, calculation may not be performed. For example, since influence on a page to be printed second is especially large, only with respect to the page to be printed second, checking may be performed. Alternatively, only pages to be printed second and third may be checked.

According to the first aspect, even in the course of the procedure of an operation, switching between conveying systems is performed. Therefore, as compared to the second aspect, the productivity is likely to increase. In the course of the procedure of an operation, in the case where the probability of fixing failure increases, it is possible to perform switching to a conveying system of simultaneously conveying less sheets. Therefore, as compared to the second aspect, the fixing failure suppressing effect is higher. Meanwhile, according to the second aspect, since switching between conveying systems is not performed in the course of the procedure of an operation, conveyance control is easy.

The first and second aspects are just examples, and do not limit the present disclosure at all. Therefore, the present disclosure can be changed and modified in various forms without departing from the scope of the present disclosure. For example, the present disclosure is not limited to printers, and can be applied to others such as multi-function apparatuses, copy machines, and fax machines as long as they have a function of forming images on both sides of each sheet. For example, the present disclosure is not limited to printers capable of color printing, and can be applied to dedicated printers for monochrome printing. The present disclosure is not limited to printers having LED type exposing units, and can be applied to printers having laser type exposing units.

For example, in the first aspect and the second aspect, when the temperature of the surface of the heating roller 81 is sufficiently high, selection of a conveying system is not performed. The selection of a conveying system may be performed regardless of the temperature of the surface. When the temperature of the surface of the heating roller 81 is sufficiently high, even though a system of perform printing on a large number of sheets per unit time is selected, fixing performance is likely to be secured. Therefore, in the case where selection of a conveying system is not performed, as compared to the case where selection of a conveying system is necessarily performed, easier control is possible.

For example, in the first aspect and the second aspect, print data is divided into a plurality of areas, and the print duties of the individual areas are obtained. The print data may not be divided into areas. For example, without performing area division, the print duty of the whole of each page may be calculated. However, in the case of performing area division, more detailed determination is possible. For example, in units of a dot, print duties may be calculated. However, in the case of performing area division and using average densities, processing is easy.

For example, in the first aspect and the second aspect, the print duty of each area is multiplied by an area-specific coefficient and a page-specific coefficient. The multiplication may not be performed. In other words, weighting may not be performed. However, in the case of performing determination using weighted values, detailed determination is possible. The system of conveying two sheets at once and the system of conveying three sheets at once use different coefficients. The system may use the same coefficients and different thresholds.

For example, in the first aspect and the second aspect, a conveying system is selected on the basis of whether or not the maximum value of the printing densities calculated with respect to the individual areas exceeds the threshold. However, the selection may be performed on the basis of whether the number of divided areas exceeding a threshold is equal to or larger than a predetermined number. For example, selection may be performed on the basis of whether or not the number of divided areas exceeding a threshold is equal to or larger than a predetermined ratio to the total number of divided areas.

Figure 14:
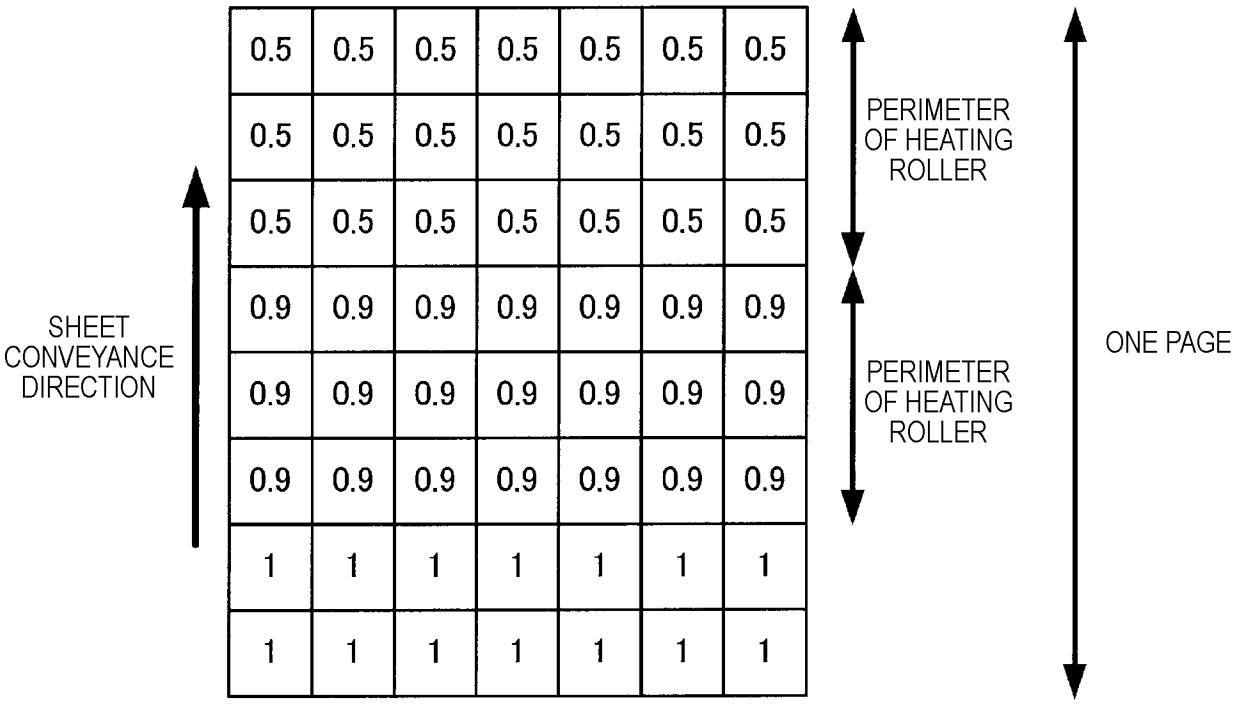
FIG. 14 is a table representing examples of coefficients for areas divided by the perimeter of a heating roller.

In the first aspect and the second aspect, as shown in FIG. 8 and FIG. 10, area-specific coefficients are set for individual areas defined by division along both of the sheet conveyance direction and the direction perpendicular to the sheet conveyance direction, respectively. However, for example, each page may be divided into blocks from the front end in the sheet conveyance direction, in units of a length corresponding to the perimeter of the heating roller 81, and as shown in FIG. 14, for the individual blocks defined by division along the sheet conveyance direction, different area-specific coefficients may be set, respectively. Setting of coefficients may be performed such that coefficients of blocks of the front end side in the sheet conveyance direction are larger than coefficients of blocks of the rear end side. Since the heating roller 81 is deprived of heat by contact with sheets, the temperature of the surface of the heating roller 81 is more likely to lower during the second rotation of the heating roller 81 as compared to the first rotation. For this reason, even in the case of setting coefficients for individual areas divided by the length corresponding to the perimeter of the heating roller 81 such that weights for blocks of the rear end side are large, the fixing failure suppressing effect is high.

The processes disclosed in the aspects may be performed by hardware such as a single CPU, a plurality of CPUs, or an ASIC, or a combination thereof. Further, the processes disclosed in the aspects can be implemented in various forms such as a recording medium retaining a program for performing those processes, or a method.

What is claimed is:

1. An image forming apparatus comprising:

a feed tray;

a transferring unit configured to transfer toner onto a sheet;

a fixing unit including a heater and a rotator configured to be heated by the heater;

an output tray;

a conveying unit configured to convey a sheet along a sheet conveyance path including a first sheet conveyance path for conveying a sheet fed from the feed tray to the output tray through the transferring unit and the fixing unit, and a second sheet conveyance path branching from the first sheet conveyance path on a downstream side of a sheet conveyance direction from the fixing unit and joining to the first sheet conveyance path on an upstream side of the sheet conveyance direction from the transferring unit, wherein the sheet conveyance direction is a direction in which a sheet is conveyed along the first sheet conveyance path; and a controller configured to:

receive image data of a plurality of pages;

calculate a specific amount related to an amount of toner per unit area of a page, where an N-th object of image formation is formed in a case of conveying sheets by conveying a first number of sheets along the sheet conveyance path by the conveying unit, in the image data, wherein the parameter "N" is equal to or larger than 2;

in a case where the specific amount is smaller than a predetermined amount, perform double-sided printing by causing the conveying unit to simultaneously convey the first number of sheets along the sheet conveyance path; and in a case where the specific amount is equal to or larger than the predetermined amount, perform double-sided printing by causing the conveying unit to simultaneously convey a second number of sheets along the sheet conveyance path, wherein the second number is smaller than the first number.

2. The image forming apparatus according to claim 1, wherein when the controller calculates the specific amount, the controller divides an image of one page of the image data into a plurality of areas to calculate the specific amount of each area, and the controller performs the double-sided printing by causing the conveying unit to convey the second number of sheets in a case where a number of divided areas, where the specific amount is equal to or larger than the predetermined amount, is equal to or larger than M, wherein the parameter "M" is equal to or larger than 1 and is smaller than a total number of divided areas in the image of one page.

3. The image forming apparatus according to claim 2, wherein the specific amount is an amount obtained by assigning a weight of each divided area to the amount of toner of the corresponding divided area, and the weight for an area at a rear end side of a sheet in the sheet conveyance direction is larger than the weight for an area at a front end side of the sheet in the sheet conveyance direction.

4. The image forming apparatus according to claim 3, wherein the weight depends on blocks divided by a length corresponding to a perimeter of the rotator of the fixing unit from the front end side of the sheet in the sheet conveyance direction, and the weight for a block at the rear end side of the sheet in the sheet conveyance direction is larger than the weight for a block at the front end side of the sheet in the sheet conveyance direction.

5. The image forming apparatus according to claim 2, wherein the specific amount is an amount obtained by assigning a weight of each divided area to the amount of toner of the corresponding divided area, and the weight for an area at end sides of a sheet in a width direction perpendicular to the sheet conveyance direction is larger than the weight for an area at a center side of the sheet in the width direction.

6. The image forming apparatus according to claim 1, wherein when the controller calculates the specific amount, the controller calculates the specific amount of each page of plural pages of the image data; and the controller performs the double-sided printing by causing the conveying unit to convey the second number of sheets in a case where at least one of the specific amounts of the plural pages is equal to or larger than the predetermined amount.

7. The image forming apparatus according to claim 6, wherein the specific amount is an amount obtained by assigning a weight of each page to the amount of toner of the corresponding page.

8. The image forming apparatus according to claim 7, wherein a weight for a page where a second object of image formation is formed is the largest out of the weights for the plural pages.

9. The image forming apparatus according to claim 1, wherein when the controller receives the image data, the controller performs the double-sided printing in a case where an elapsed time from previous printing exceeds a threshold time, and the controller performs the double-sided printing by causing the conveying unit to convey the first number of sheets in a case where the elapsed time from previous printing does not exceed the threshold time.

10. The image forming apparatus according to claim 1, wherein when the controller receives the image data, the controller performs the double-sided printing in a case where a temperature of the rotator of the fixing unit does not exceed a threshold temperature, and the controller performs the double-sided printing by causing the conveying unit to convey the first number of sheets in a case where the temperature of the rotator of the fixing unit exceeds the threshold temperature.

11. The image forming apparatus according to claim 1, wherein when the controller performs the double-sided printing by causing the conveying unit to convey the first number of sheets, the controller causes the conveying unit to start sheet conveyance under the same start condition as a start condition for causing the conveying unit to start of conveying the second number of sheets.

12. An image forming apparatus comprising:

a feed tray;

a transferring unit configured to transfer toner onto a sheet;

a fixing unit including a heater and a rotator configured to be heated by the heater;

an output tray;

a conveying unit configured to convey a sheet along a sheet conveyance path including a first sheet conveyance path for conveying a sheet fed from the feed tray to the output tray through the transferring unit and the fixing unit, and a second sheet conveyance path branching from the first sheet conveyance path on a downstream side of a sheet conveyance direction from the fixing unit and joining to the first sheet conveyance path on an upstream side of the sheet conveyance direction from the transferring unit, wherein the sheet conveyance direction is a direction in which a sheet is conveyed along the first sheet conveyance path; and a controller configured to:

receive image data of a plurality of pages;

calculate a specific amount related to an amount of toner per unit area of a page, where an N-th object of image formation is formed in a case of performing double-sided printing, wherein while conveying one sheet along the second sheet conveyance path from a branch point of the first sheet conveyance path and the second sheet conveyance path to a joint point of the first sheet conveyance path and the second sheet conveyance path, the controller causes the conveying unit to convey a sheet other than the one sheet along the first sheet conveyance path, in the image data, wherein the parameter "N" is equal to or larger than 2;

in a case where the specific amount is smaller than a predetermined amount, perform the double-sided printing, wherein while conveying one sheet along the second sheet conveyance path from a branch point of the first sheet conveyance path and the second sheet conveyance path to a joint point of the first sheet conveyance path and the second sheet conveyance path, the controller causes the conveying unit to convey a sheet other than the one sheet along the first sheet conveyance path; and in a case where the specific amount is equal to or larger than the predetermined amount, perform double-sided printing, wherein while conveying one sheet along the second sheet conveyance path from the branch point of the first sheet conveyance path and the second sheet conveyance path to the joint point of the first sheet conveyance path and the second sheet conveyance path, the controller causes the conveying unit not to convey a sheet other than the one sheet along the first sheet conveyance path.

13. A sheet conveying method of an image forming apparatus that includes:

a feed tray;

a transferring unit configured to transfer toner onto a sheet;

a fixing unit including a heater and a rotator configured to be heated by the heater;

an output tray;

a conveying unit configured to convey a sheet along a sheet conveyance path including a first sheet conveyance path for conveying a sheet fed from the feed tray to the output tray through the transferring unit and the fixing unit, and a second sheet conveyance path branching from the first sheet conveyance path on a downstream side of a sheet conveyance direction from the fixing unit and joining to the first sheet conveyance path on an upstream side of the sheet conveyance direction from the transferring unit, wherein the sheet conveyance direction is a direction in which a sheet is conveyed along the first sheet conveyance path; and a controller, the method, executed by the controller, comprises the steps of:

receiving image data of a plurality of pages;

calculating a specific amount related to an amount of toner per unit area of a page, where an N-th object of image formation is formed in a case of conveying sheets by conveying a first number of sheets along the sheet conveyance path by the conveying unit, in the image data, wherein the parameter "N" is equal to or larger than 2;

in a case where the specific amount is smaller than a predetermined amount, performing double-sided printing by causing the conveying unit to simultaneously convey the first number of sheets along the sheet conveyance path; and in a case where the specific amount is equal to or larger than the predetermined amount, performing double-sided printing by causing the conveying unit to simultaneously convey a second number of sheets along the sheet conveyance path, wherein the second number is smaller than the first number.

14. An image forming apparatus comprising:

a feed tray configured to stock sheets;

an image forming unit configured to provide toner on a sheet conveyed from the feed tray to form an image based on image data on the sheet;

a re-conveying unit configured to convey the sheet that the image is formed by the image forming unit along a circulation path to feed the sheet back to the image forming unit; and a controller configured to:

calculate, according to the image data, a specific value related to an amount of toner provided on the sheet to form the image;

determine whether or not the calculated specific value is larger than a predetermined threshold;

in a case where the controller determines that the specific value does not exceed the predetermined threshold, control the re-conveying unit to convey a first number of sheets held along the circulation path; and in a case where the controller determines that the specific value exceeds the predetermined threshold, control the re-conveying unit to convey a second number of sheets held along the circulation path, wherein the second number is smaller than the first number.

* * * * *